US011156395B2

(12) United States Patent
Oh et al.

(10) Patent No.: US 11,156,395 B2
(45) Date of Patent: Oct. 26, 2021

(54) REFRIGERATOR

(71) Applicant: LG ELECTRONICS INC., Seoul (KR)

(72) Inventors: Minkyu Oh, Seoul (KR); Yongnam Kim, Seoul (KR); Yanghwan No, Seoul (KR); Seongwoo An, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 153 days.

(21) Appl. No.: 16/431,238

(22) Filed: Jun. 4, 2019

(65) Prior Publication Data

US 2020/0011586 A1 Jan. 9, 2020

(30) Foreign Application Priority Data

Jul. 5, 2018 (KR) ..... 10-2018-0078121

(51) Int. Cl.
*F25D 17/08* (2006.01)
*F25D 23/10* (2006.01)
*F25D 23/00* (2006.01)

(52) U.S. Cl.
CPC ..... *F25D 17/08* (2013.01); *F25D 23/003* (2013.01); *F25D 23/10* (2013.01); *F25D 2323/0021* (2013.01); *F25D 2323/00261* (2013.01); *F25D 2323/00262* (2013.01); *F25D 2323/00282* (2013.01)

(58) Field of Classification Search
CPC ..... F25B 21/02; F25D 3/00; F25D 11/006; F25D 17/08; F25D 2323/0021; F25D 2323/00262; F25D 17/062
See application file for complete search history.

(56) References Cited

U.S. PATENT DOCUMENTS 3,451,904 A * 6/1969 Jaremus ..... H01L 35/32 205/203
5,505,046 A 4/1996 Nelson et al.
5,522,216 A * 6/1996 Park ..... F25D 11/006 62/3.6
2003/0226363 A1* 12/2003 Lee ..... F25D 29/008 62/3.6
2011/0315783 A1* 12/2011 Baker ..... C12M 41/14 236/3

FOREIGN PATENT DOCUMENTS

CN 2064485 U 10/1990
CN 1146238 A 3/1997
CN 202687120 U 1/2013
CN 104019506 A 9/2014
(Continued)

OTHER PUBLICATIONS

English translation of JP7-218083 (Year: 1996).*

*Primary Examiner* — Cassey D Bauer
(74) *Attorney, Agent, or Firm* — Dentons US LLP

(57) ABSTRACT

A refrigerator includes a thermoelectric element module disposed at a wall of a storing chamber and includes a heat-absorbing sink and a heat-dissipating sink; a supply duct disposed at an inner case to discharge cold air, which has exchanged heat in the heat-absorbing sink, to a storing chamber; and a cold air accumulation agent disposed in the supply duct and cooled by the cold air flowing through the supply duct.

20 Claims, 25 Drawing Sheets

(56) References Cited

FOREIGN PATENT DOCUMENTS

| | | | | |
|---|---|---|---|---|
| CN | 207550831 | U | | 6/2018 |
| JP | 7-218083 | | * | 8/1995 |
| KR | 10-0569935 | A | | 4/2006 |
| KR | 1020160145885 | A | | 12/2016 |
| KR | 10-2018-0049670 | A | | 5/2018 |
| WO | 95/19533 | A1 | | 7/1995 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2018-0078121 (filed on Jul. 5, 2018), which is hereby incorporated by reference in its entirety.

FIELD OF THE DISCLOSURE

The present disclosure relates to a refrigerator that may be driven with small noise by employing a thermoelectric element.

BACKGROUND

A thermoelectric element generates and absorbs heat using Peltier effect. The Peltier effect is an effect in which an endothermic phenomenon occurs on one side and an exothermic phenomenon occurs on the other side, depending on the direction of a current, when a voltage is applied to both ends of the element. The thermoelectric element may be used in a refrigerator instead of a refrigeration cycle apparatus.

In general, a refrigerator is an apparatus that has a food storage space therein being able to be blocked from heat permeating from the outside by a cabinet and a door which are filled with an insulating material. The refrigerator includes a cooling system composed of an evaporator absorbing heat from the inside of the food storage space and a heat dissipater discharging collected heat to the outside of the food storage space, and keeps stored food without spoiling for a long period of time by maintaining the food storage space within a low temperature range in which microorganisms are difficult to live and propagate.

Refrigerators may be divided into a refrigerator compartment for keeping food within an above-zero degree celsius temperature range and a freezer compartment for keeping food within a below-zero degree celsius temperature range. Refrigerators may be, depending on the positions of the refrigerator compartment and the freezer compartment, classified into a top-freezer refrigerator with an upper freezer compartment and a lower refrigerator compartment, a bottom-freezer refrigerator with a lower freezer compartment and an upper refrigerator compartment, and a side-by-side refrigerator with a left freezer compartment and a right refrigerator compartment.

Further, refrigerators may have a plurality of shelves and drawers in the food storage space so that a user can conveniently load/take food into/out of the food storage space.

Meanwhile, a built-in refrigerator is a refrigerator that is embedded, for example, in furniture or a wall when a building is initially constructed. Common refrigerators may be installed in open spaces, whereas built-in refrigerators may be embedded in furniture or a wall. Accordingly, built-in refrigerators are vulnerable in terms of heat dissipation when compared to common refrigerators.

The applicant(s) have filed an application in the Republic of Korea and have had the application registered with regard to a built-in refrigerator.

1. Registration No. (Registration Date): 10-0569935 (2006.04.04.)

2. Title of Invention: Radiating apparatus of built-in refrigerator

According to this patent document, air is suctioned through the bottom of the refrigerator from a machine room and is then discharged rearward out of the refrigerator. The air discharged rearward out of the refrigerator is moved up by natural convection.

However, since the machine room is generally disposed at the lower end of the refrigerator, the hot air discharged rearward out of the refrigerator influences the entire rear side of the refrigerator. This is because the air that is moved up by natural convection keeps in contact with the entire rear side of the refrigerator. Accordingly, thermal insulation load and performance required for the refrigerator may be adversely influenced.

Further, a phenomenon that the air discharged rearward from the refrigerator being suctioned back into the machine room without being moved up may occur. In particular, when the left and right sides of the refrigerator are blocked such as in a built-in refrigerator, there is high possibility that hot air is suctioned back into the machine room.

Further, there is a problem that noise generated by the refrigerator is increased due to operation of a compressor.

SUMMARY

One aspect is to provide a built-in refrigerator that may reduce noise. For example, a refrigerator includes a structure in which a storing chamber is cooled by a thermoelectric element and heat dissipation flow may be formed by a fan of the thermoelectric element.

Another aspect is to provide a refrigerator that may easily cool objects stored close to a door by extending a supply duct for supplying cold air to a storing chamber forward towards the door from a rear wall of a cabinet.

Another aspect is to provide a refrigerator that may maintain a storing chamber at a low temperature to prevent objects stored in the refrigerator from spoiling when carried even if the refrigerator is moved to another place from a built-in place. For example, the refrigerator may maintain a storing chamber at low temperature even if cold air is not supplied from a thermoelectric element when the refrigerator is moved, by disposing a cold air accumulation agent in the supply duct.

Another aspect is to provide a refrigerator that may easily cool a storing chamber because cold air exchanges heat with a heat-absorbing sink of a thermoelectric element module and the cold air that has exchanged heat is supplied to the storing chamber through a cold air circulation fan. For example, the refrigerator may efficiently supply cold air because the cold air circulation fan is disposed on an area wall of a cabinet and the cold air passing through the cold air circulation fan is supplied to a rear wall of the cabinet and to the storing chamber upward.

Another aspect is to provide a refrigerator that may easily dissipate heat by including an external air circulation fan that forcibly introduces or discharges external air. For example, the refrigerator in which external air may easily exchange heat with a heat-dissipating sink of a thermoelectric element module by disposing a heat dissipation duct outside the storing chamber and circulating external air through the heat dissipation duct.

Another aspect is to provide a refrigerator that may prevent cold air passing through a heat dissipation duct from flowing into a storing chamber through a door by disposing an inlet-outlet grill, which guides external air into and out of the heat dissipation duct, at an angle.

Another aspect is to provide a refrigerator having a structure in which a cold air channel may be easily formed around a cold air accumulation agent when the cold air accumulation agent is disposed in a supply duct.

Another aspect is to provide a refrigerator in which a cold air accumulation agent may be easily attached to and detached from a supply duct by disposing a duct cover on the supply duct.

A refrigerator according to an embodiment of the present invention includes a thermoelectric element module disposed at a wall of a storing chamber and includes a heat-absorbing sink and a heat-dissipating sink; a supply duct disposed at an inner case to discharge cold air, which has exchanged heat in the heat-absorbing sink, to the storing chamber; and a cold air accumulation agent disposed in the supply duct and cooled by cold air flowing through the supply duct, thereby being able to easily cool the storing chamber and reduce noise.

The supply duct includes a first supply duct disposed on a rear wall of the storing chamber and having a first discharge hole for discharging the cold air to the storing chamber; and a second supply duct extending forward from an upper portion of the first supply duct and having the cold air accumulation agent therein, so it is possible to easily cool the front of the storing chamber.

The supply duct includes: a first supply duct disposed on the rear wall of the storing chamber and having a first discharge hole for discharging the cold air to the storing chamber; and a third supply duct extending forward from a lower portion of the first supply duct and having the cold air accumulation agent therein, so it is possible to easily cool the front of the storing chamber.

The supply duct includes: a first supply duct disposed on the rear wall of the storing chamber and having a first discharge hole; a second supply duct disposed on an upper wall of the storing chamber and having a second discharge hole; and a third supply duct disposed on a lower wall of the storing chamber and having a third discharge hole.

Since the cold air accumulation agent is disposed in at least one of the second supply duct and the third supply duct, a flat plate-shaped cold air accumulation agent may be easily installed.

The supply duct includes first and second channels divided by the cold air accumulation agent and allowing the cold air to flow therein, so the cold air flows smoothly in the supply duct.

The supply duct has a supporting rib that supports the top or the bottom of the cold air accumulation agent, thereby preventing movement of the cold air accumulation agent.

A duct discharge hole for discharging the cold air to the storing chamber is formed at a bottom surface of the second supply duct or a top surface of the third supply duct, so the storing chamber is easily cooled.

The refrigerator includes a heat dissipation duct is disposed at a cabinet insulator to discharge exhaust air, which has exchanged heat in the heat-dissipating sink, to the outside of the refirgerator.

The heat dissipation duct includes: a first heat dissipation duct disposed at a rear portion of the cabinet insulator and having the heat-dissipating sink therein; a second heat dissipation duct extending forward from an upper portion of the first heat dissipation duct and having a first inlet-outlet portion for introducing or discharging the external air; and a third heat dissipation duct extending forward from a lower portion of the first heat dissipation duct and having a second inlet-outlet portion for introducing or discharging the external air.

The refrigerator includes a first inlet-outlet grill disposed over the door and communicating with the first inlet-outlet portion; and a second inlet-outlet grill disposed under the door and communicating with the second inlet-outlet portion.

The refrigerator further includes a plurality of guide ribs disposed at the first inlet-outlet grill or the second inlet-outlet grill and extending at an angle upward or downward with respect to a horizontal axis; and inlet-outlet holes disposed between the plurality of guide ribs.

The cold air circulation fan includes a centrifugal fan disposed at a center portion in the up-down direction of the first supply duct.

The heat dissipation fan includes a first heat dissipation fan disposed at a joint of the first heat dissipation duct and the second heat dissipation duct; and a second heat dissipation fan disposed at a joint of the first heat dissipation duct and the third heat dissipation duct.

The first heat dissipation fan or the second heat dissipation fan includes a centrifugal fan.

The refrigerator includes a duct cover that may open an internal channel of the supply duct.

The refrigerator further includes: a shelf disposed in the storing chamber; and a shelf cold air accumulation agent disposed in the shelf, so objects on the shelf are easily cooled.

According to the embodiment, since it is possible to generate cold air and dissipate heat using the cold air accumulation agent, it is possible to reduce noise that is generated by the refrigerator.

Further, since it is possible to disposing the supply duct for supplying cold air to the storing chamber forward toward the door from the rear wall of the cabinet to be positioned close to the door, the storing chamber may be uniformly cooled.

Further, since the cold air accumulation agent is disposed in the supply duct, it is possible to maintain the storing chamber at low temperature even though cold air is not supplied from the duct when the refrigerator is moved.

Further, since cold air exchanges heat with a heat-absorbing sink of a thermoelectric element module and the cold air that has exchanged heat is supplied to the storing chamber through a cold air circulation fan, it is possible to easily cool a storing chamber. For example, since the cold air circulation fan is disposed on the area wall of a cabinet and the cold air passing through the cold air circulation fan is supplied to the rear wall of the cabinet and to the storing chamber upward, it is possible to efficiently supply cold air.

Further, since there is provided an external air circulation fan that forcibly introduce and discharge external air, heat may be uniformly dissipated from the refrigerator. For example, external air may easily exchange heat with a heat-dissipating sink of a thermoelectric element module by disposing a heat dissipation duct outside the storing chamber and circulating external air through the duct.

Further, since an inlet-outlet grill, which guides external air into and out of the heat dissipation duct, is disposed at an angle, it is possible to prevent cold air passing through a heat dissipation duct from flowing into a storing chamber through a door.

Further, since the cold air accumulation agent may be stably supported by the supporting ribs, a cold air channel may be easily formed around the cold air accumulation agent in the supply duct.

Further, since the duct cover is disposed on the supply duct, the cold air accumulation agent may be easily attached to and detached from the supply duct.

DETAILED DESCRIPTION OF THE EMBODIMENTS

Figure 1:
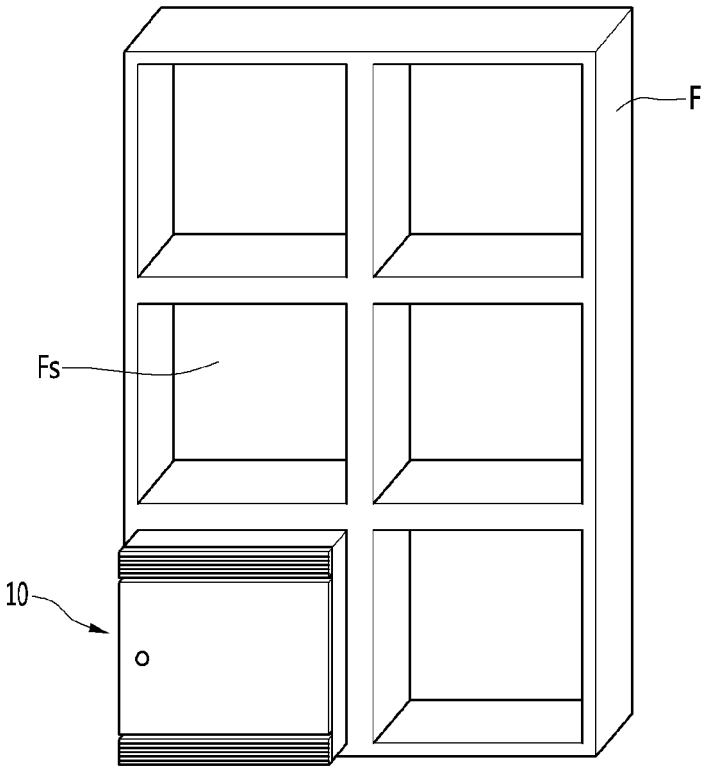
FIG. 1 is a view showing a state in which a refrigerator according to a first embodiment of the present invention has been built in a piece of furniture.

Hereinafter, embodiments of the present invention are described in detail with reference to exemplary drawings. It should be noted that when components are given reference numerals in the drawings, the same or similar components may be given the same reference numerals even when they are shown in different drawings. Further, in the following description of embodiments of the present invention, when detailed description of well-known configurations or functions is determined as interfering with understanding of the embodiments of the present invention, they are not described in detail.

Terms 'first', 'second', 'A', 'B', '(a)', and '(b)' may be used in the following description of the components of embodiments of the present invention. The terms are provided only for discriminating components from other components and, the essence, sequence, or order of the components are not limited by the terms. When a component is described as being "connected", "combined", or "coupled" with another component, it should be understood that the component may be "connected", "combined" or "coupled" to another component directly or with another component interposing therebetween.

FIG. 1 is a view showing a state in which a refrigerator according to a first embodiment of the present invention has been built in a piece of furniture.

Referring to FIG. 1, the refrigerator 10 according to the first embodiment of the present invention may be understood as a built-in refrigerator that is embedded in a wall or furniture in a house or an office. For example, FIG. 1 shows the state in which the refrigerator 10 has been installed in a receiving space Fs formed in a predetermined piece of furniture F.

The refrigerator 10 may be installed and fixed or may be separably installed in the furniture F. That is, the refrigerator 10 may be a portable refrigerator that may be inserted and used in the receiving space Fs of the furniture F in ordinary times, and when there is an event such as a picnic, may be separated from the furniture F and then carried and used like an icebox.

The refrigerator 10 may be configured to have a relatively small size and light weight to be easily carried by a user. For example, the dimensions of the width, length, and height of the refrigerator 10 may be 30-50 cm or less and the weight may be 10-15 kg or less.

Figure 2:
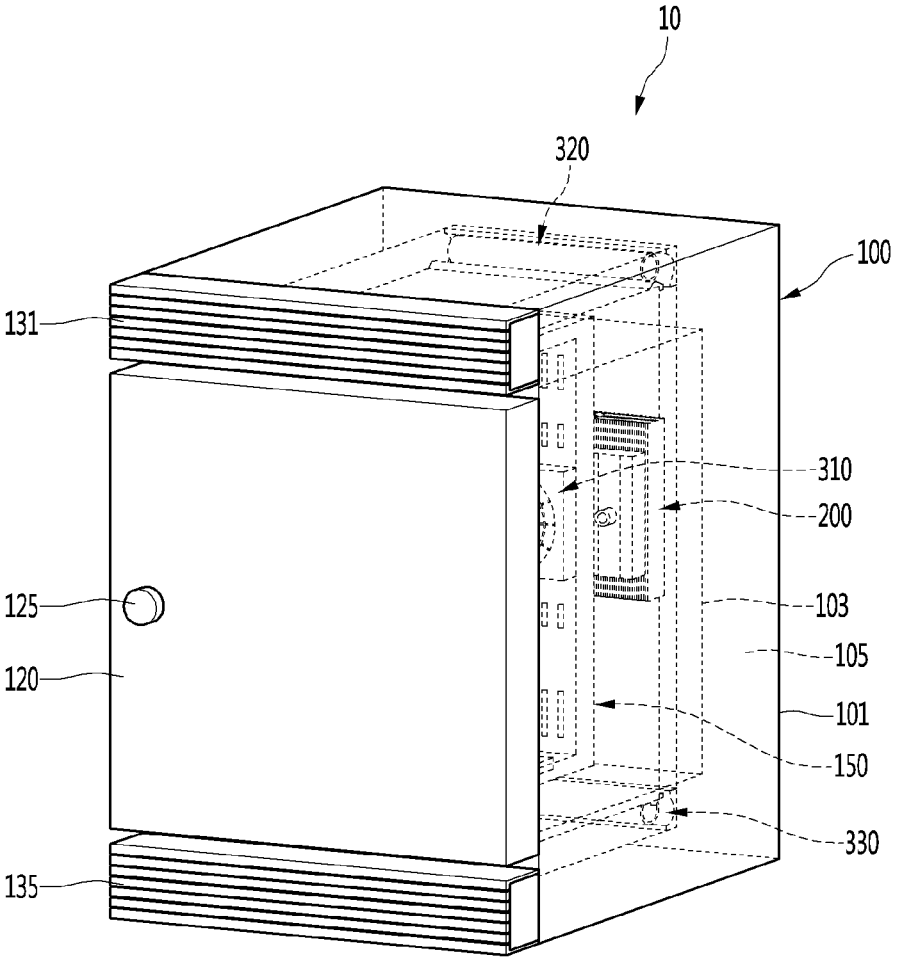
FIG. 2 is a view showing a configuration of the refrigerator according to the first embodiment of the present invention.
Figure 3:
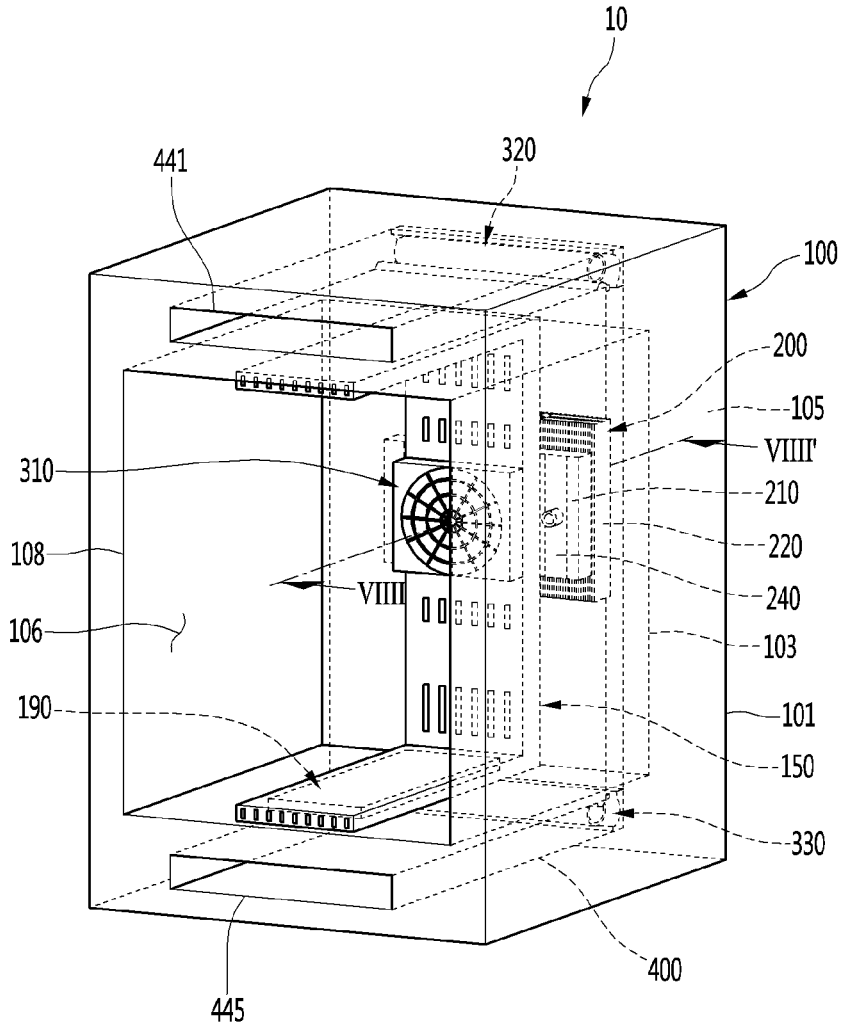
FIG. 3 is a view showing an internal configuration of a cabinet according to the first embodiment of the present invention.
Figure 9:
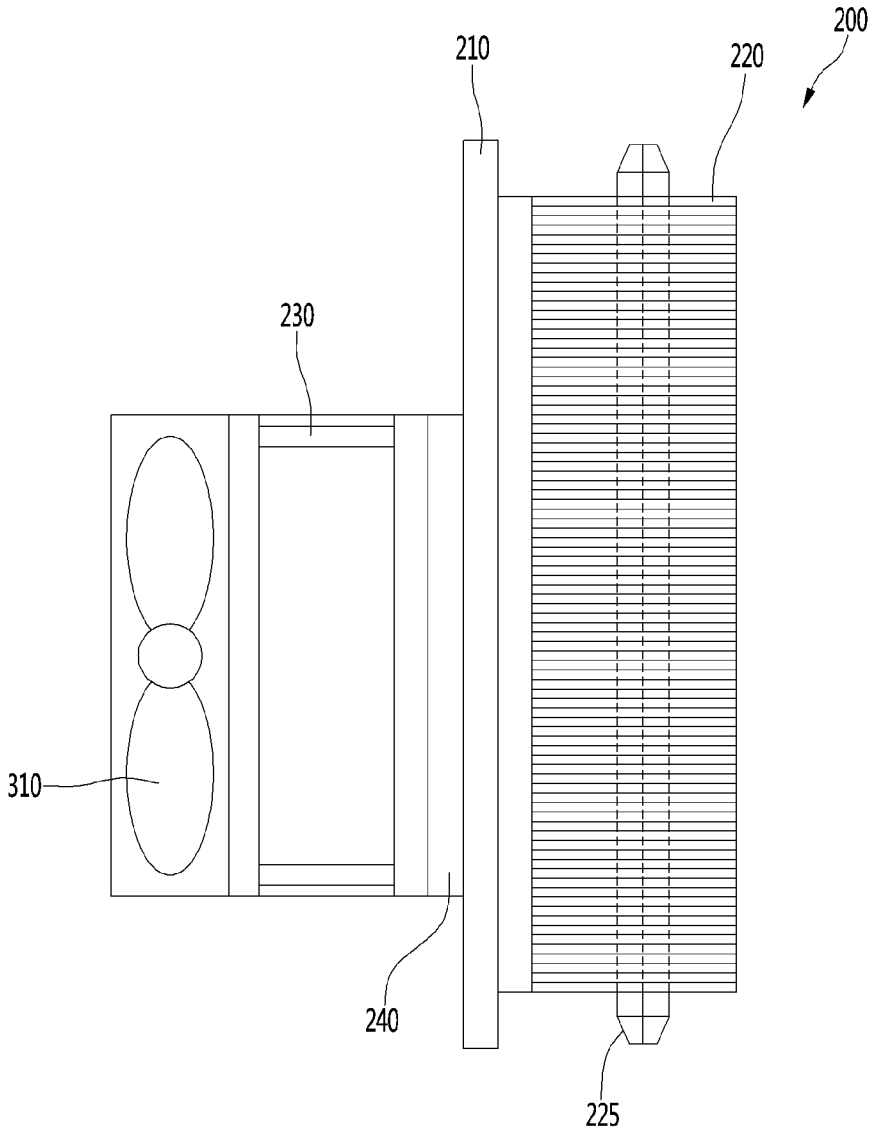
FIG. 9 is a view showing a configuration of a thermoelectric element module according to an embodiment of the present invention.

FIG. 2 is a view showing a configuration of the refrigerator according to the first embodiment of the present invention, FIG. 3 is a view showing an internal configuration of a cabinet according to the first embodiment of the present invention, and FIG. 9 is a view showing a configuration of a thermoelectric element module according to an embodiment of the present invention.

Referring to FIGS. 2, 3, and 9, the refrigerator 10 according to the first embodiment of the present invention includes a cabinet 100 that forms an external shape and forms a storing chamber 106 for keeping food and a door 120 for closing the storing chamber 106. For example, the cabinet 100 may be configured to have a rectangular parallelepiped shape with an open front and the door 120 may have a rectangular panel shape.

The door 120 may be rotatably provided. For example, the door 120 may have a first side hinged to the cabinet 120 and a second side being rotatable forward about the first side of the door 120. The first side may be a right side and the second side may be a left side. A handle 125 that is operated by a user may be disposed on the front side of the door 120.

The cabinet 100 includes an outer case 101 and an inner case 103 disposed in the outer case 101 and forming the walls of the storing chamber 106. The outer case 101 may have a shape corresponding to the receiving space Fs of the furniture F and may be configured to surround the outer side of the inner case 103.

The cabinet 100 includes a cabinet insulator 105 disposed between the outer case 101 and the inner case 103 and insulating the storing chamber 106 and the refrigerator 10 from the outside environment. For example, the cabinet insulator 105 may be polyurethane foam.

The refrigerator 10 further includes a thermoelectric element module 200 disposed in the cabinet 100 for generating cold air. For example, the thermoelectric element module 200 may be disposed on a rear wall of the storing chamber 106. The refrigerator 10 does not include parts for driving a refrigeration cycle, for example, parts generating large noise such as a compressor, so an effect of reducing noise while the refrigerator 10 is driven may be obtained.

The thermoelectric element module 200 may be disposed on the rear wall of the storing chamber 106 to cool the storing chamber 106. The thermoelectric element module 200 includes a thermoelectric element and the thermoelectric element is an element that performs cooling and generates heat using a Peltier effect. When the heat-absorbing side of the thermoelectric element is disposed to face the storing chamber 106 and the heat-generating side is disposed to face the outside of the refrigerator 10, and thus the storing chamber 106 may be cooled by operation of the thermoelectric element.

The thermoelectric element module 200 includes a module body 210 to which the thermoelectric element is coupled and that has a rectangular plate shape, a heat-absorbing sink 230 that is disposed on a first side of the module body 210 and exchanges heat with cold air in the storing chamber 106, and a heat-dissipating sink 220 that is disposed on a second side of the module body 210 and exchanges heat with external air outside of the refrigerator 10.

The first side of the module body 210 may be the side facing the storing chamber 106 and the second side may be the side facing the outside of the refrigerator 10 with respect to the thermoelectric element module 200.

The heat-absorbing sink 230 is disposed in contact with the heat-absorbing portion of the thermoelectric element and the heat-dissipating sink 220 is disposed in contact with the heat-dissipating portion of the thermoelectric element. The heat-absorbing portion and the heat-dissipating portion of the thermoelectric element may have a shape that may be in surface contact with each other, and may form opposite surfaces.

Heat has to be quickly dissipated from the heat-dissipating portion of the thermoelectric element of the thermoelectric element module 200 so that heat may be sufficiently absorbed at the heat-absorbing portion of the thermoelectric element. Accordingly, the heat exchange area of the heat-dissipating sink 220 may be larger than the heat exchange area of the heat-absorbing sink 230.

The heat-dissipating sink 220 and the heat-absorbing sink 230 each may include a base being in contact with the thermoelectric element and a heat exchange fin coupled to the base.

Further, the heat-dissipating sink 220 may further include a heat pipe 225 in order to quickly dissipate heat. The heat pipe 225 is configured to receive heat transfer fluid therein and may be disposed such that an end passes through the base and the other end passes through the heat transfer fin.

The thermoelectric element module 200 may further include a module insulator 240 disposed between the heat-absorbing sink 230 and the heat-dissipating sink 220. For example, the module insulator 240 may be disposed to surround the edge of the thermoelectric element.

A cold air circulation fan 310 that forcibly circulates cold air in the storing chamber 106 may be disposed ahead of the thermoelectric element module 200, that is, at a side facing the storing chamber 106. The cold air circulation fan 310 may be positioned ahead of the heat-absorbing sink 230. For example, the cold air circulation fan 310 may include a centrifugal fan that laterally sucks and radially discharges cold air.

The refrigerator 10 further includes a supply duct 150 that guides a flow of cold air generated by the circulation fan 310. The supply duct 150 may be disposed in the inner case 103 and may supply cold air towards the storing chamber 106. In detail, the cold air existing in the storing chamber 106 may flow into the supply duct 150 and the supply duct 150 may discharge the air that has exchanged heat with the heat-absorbing sink 230 back into the storing chamber 106.

The supply duct 150 may be disposed on the rear wall, upper wall, and lower wall of the storing chamber 106 to discharge heat exchanged air to the storing chamber 106. For example, the supply duct 150 may be disposed to have a U-shape by being bent at least two times along the elongated length. The bending angle along the elongated length of the supply duct 150 may be 90 degrees.

The heat-absorbing sink 230 of the thermoelectric element module 200 may be disposed in the supply duct 150. Accordingly, the cold air flowing in the supply duct 150 may be cooled by exchanging heat with the heat-absorbing sink 230. The cooled cold air may be discharged from the supply duct 150 into the storing chamber 106.

A cold air accumulation agent 190 may be disposed in the supply duct 150. The cold air accumulation agent 190 stores the coldness of the cold air by being cooled by the cold air flowing through the supply duct 150, and when the cold air circulation fan 310 is stopped, for example, when the refrigerator 10 is being carried, it keeps the storing chamber 106 cooled by discharging the stored coldness of the cold air. The cold air accumulation agent 190 may include a phase change material (PCM) that discharges cold air during a phase change process. For example, the cold air accumulation agent 190 may include water or ice, clathrate, and eutectic salt.

The refrigerator 10 further includes a heat dissipation duct 400 that guides flow of external air. The external air outside the refrigerator 10 flows into the heat dissipation duct 400 and the heat dissipation duct 400 may discharge the external air, which has exchanged heat with the heat-dissipating sink 220, back to the outside of the refrigerator 10. The heat-dissipating sink 220 may be disposed in the heat dissipation duct 400.

The heat dissipation duct 400 may be embedded in the cabinet insulator 105 and may be disposed at a rear portion, upper portion, and lower portion of the cabinet 100. For example, the heat dissipation duct 400 may be disposed to have a U-shape by being bent at least two times along the elongated length. The bending angle along the elongated length of the heat dissipation duct 400 may be 90 degrees. The heat dissipation duct 400 may be disposed to surround an outer side of the supply duct 150.

The heat dissipation duct 400 may have a first inlet-outlet portion 441 and a second inlet-outlet portion 442. The first inlet-outlet portion 441 may be disposed at an end of the upper portion of the heat dissipation duct 400 and the second inlet-outlet portion 445 may be disposed at an end of the lower portion of the heat dissipation duct 400.

The refrigerator 100 may further include heat dissipation fans 320 and 330 disposed in the channel in the heat dissipation duct 400 to force external air to flow through the heat dissipation duct 400. The heat dissipation fans 320 and 330 include a first heat dissipation fan 320 disposed at the upper portion of the heat dissipation duct 400 and a second heat dissipation fan 330 disposed at the lower portion of the heat dissipation duct 400. The first heat dissipation fan 320 may be disposed at an upper bending portion of the heat dissipation duct 400 and the second heat dissipation fan 330 may be disposed at a lower bending portion of the heat dissipation duct 400.

The flow direction of external air in the first and second inlet-outlet portions 441 and 445 may depend on the rotational direction of the first and second heat dissipation fans 320 and 330. This configuration will be described below with reference to the drawings.

Inlet-outlet grills 131 and 135 that allows external air to flow into the heat dissipation duct 400 or discharges the external air, which has exchanged heat in the heat dissipation duct 400, to the outside of the refrigerator. The inlet-outlet grills 131 and 135 include a first inlet-outlet grill 320 disposed at an upper portion of the cabinet 100 and a second inlet-outlet grill 330 disposed at a lower portion of the cabinet 100.

The first inlet-outlet grill 320 may be positioned over the door 120 and may be positioned ahead of the first inlet-outlet portion 441 to communicate with the first inlet-outlet portion 441. The second inlet-outlet grill 135 may be positioned under the door 120 and may be positioned ahead of the second inlet-outlet portion 445 to communicate with the second inlet-outlet portion 445.

Figure 4:
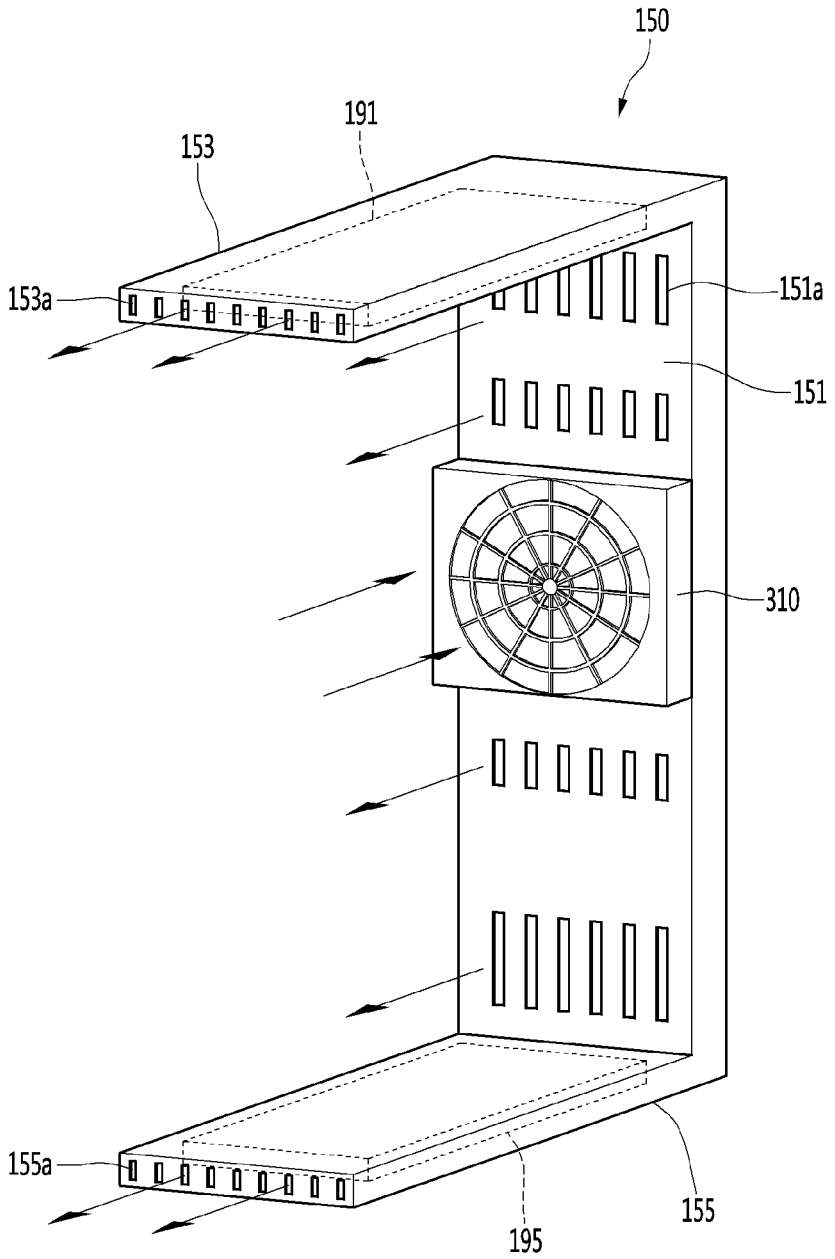
FIG. 4 is a perspective view showing a configuration of a supply duct according to the first embodiment of the present invention.
Figure 5:
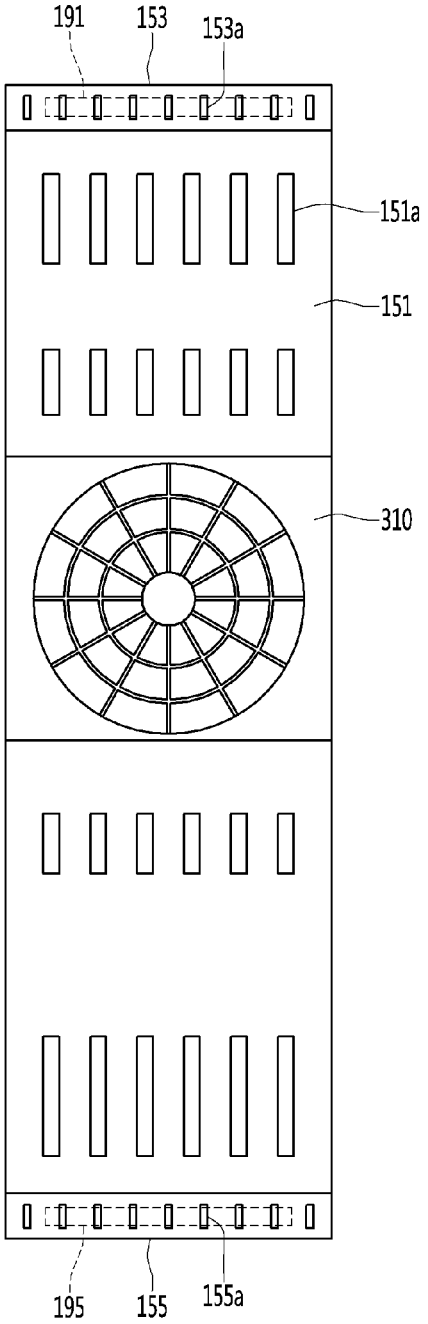
FIG. 5 is a front view showing the configuration of the supply duct according to the first embodiment of the present invention.
Figure 6:
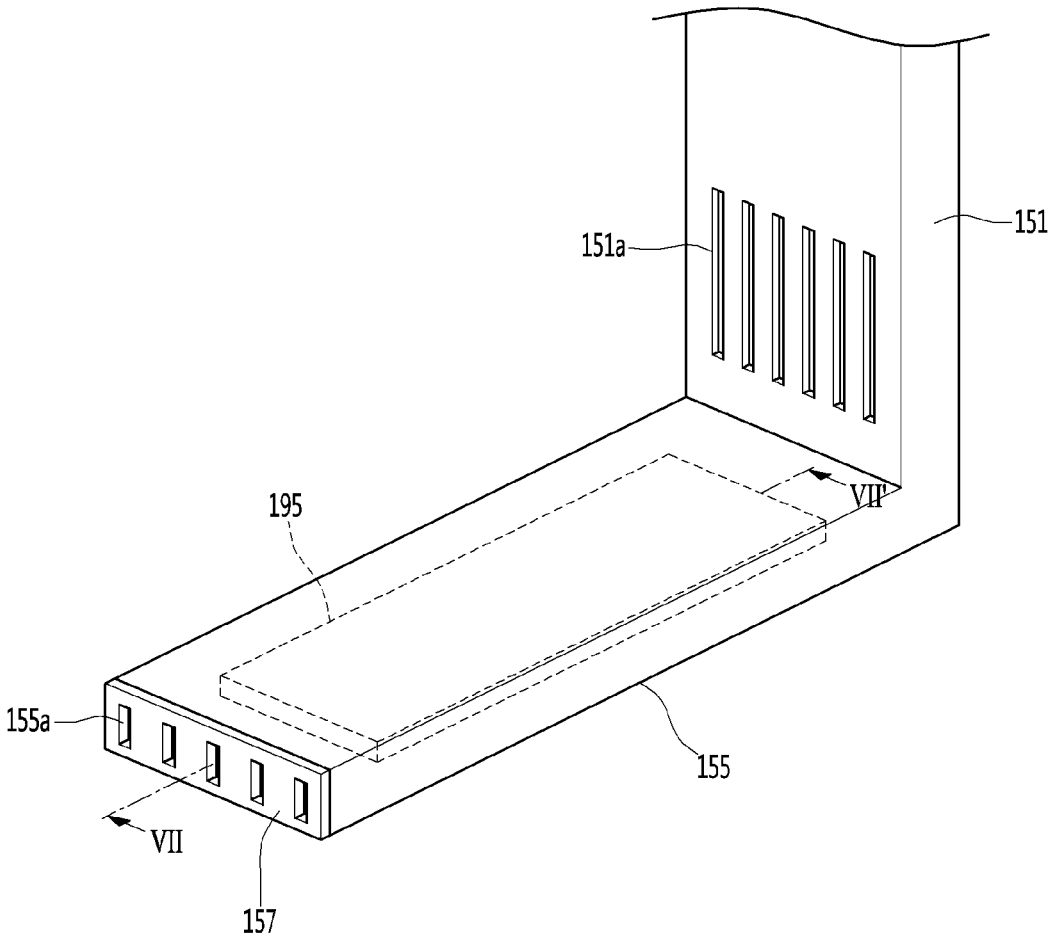
FIG. 6 is a view showing a state in which a cold air accumulation agent according to the first embodiment of the present invention has been disposed in the supply duct.
Figure 7:
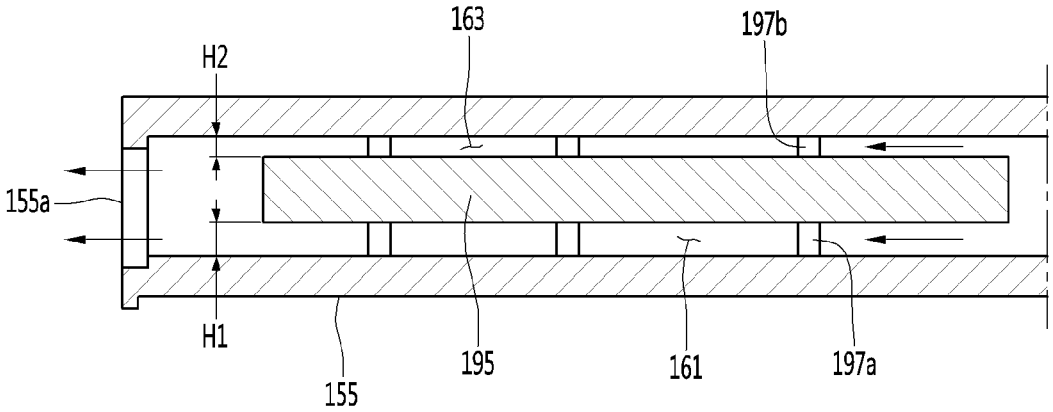
FIG. 7 is a cross-sectional view taken along line VII-VII' of FIG. 6.
Figure 8:
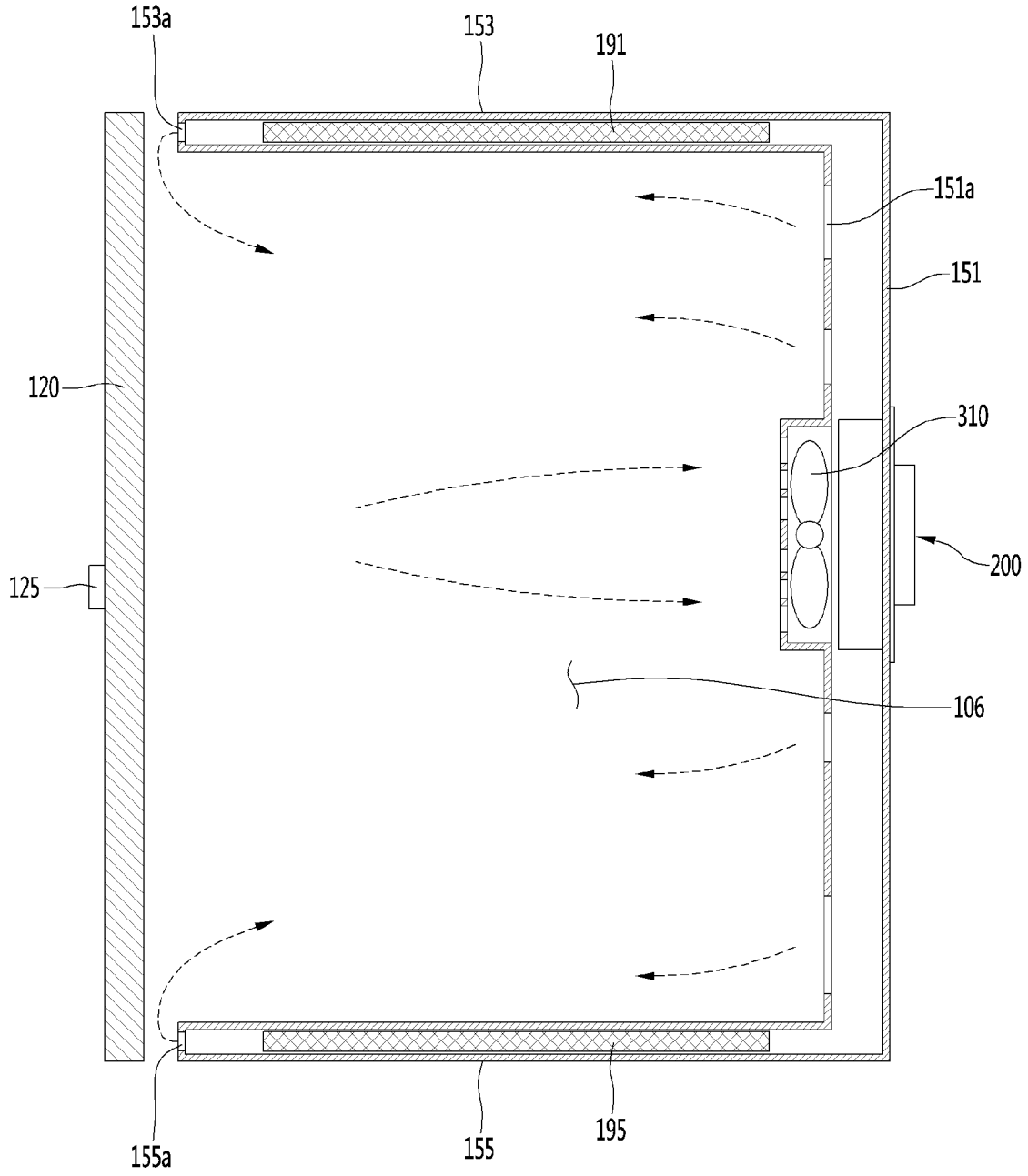
FIG. 8 is a view showing a state in which air is supplied from the supply duct to a storing chamber according to the first embodiment of the present invention.

FIG. 4 is a perspective view showing a configuration of the supply duct according to the first embodiment of the present invention, FIG. 5 is a front view showing the configuration of the supply duct according to the first embodiment of the present invention, FIG. 6 is a view showing a state in which the cold air accumulation member according to the first embodiment of the present invention has been disposed in the supply duct, FIG. 7 is a cross-sectional view taken along line VII-VII' of FIG. 6, and FIG. 8 is a view showing a state in which air is supplied from the supply duct to the storing chamber according to the first embodiment of the present invention.

Referring to FIGS. 4 to 8, the supply duct 150 according to the first embodiment of the present invention may be disposed on the rear wall, upper wall, and lower wall of the storing chamber 106.

In detail, the supply duct 150 includes a first supply duct 151 disposed on the inner case 103 forming the rear wall of the storing chamber 106. The first supply duct 151 may extend up and down on the rear wall of the storing chamber 106. The cold air circulation fan 310 may be disposed at a center portion of the up-down direction of the first supply duct 151.

The heat-absorbing sink 230 of the thermoelectric element module 200 may be positioned in the first supply duct 151. Accordingly, the cold air flowing through the first supply duct 151 may exchange heat with the heat-absorbing sink 230.

When the cold air circulation fan 310 is driven, the cold air existing in the storing chamber 103 flows toward the cold air circulation fan 310 and may be cooled through the heat-absorbing sink 230 disposed behind the cold air circulation fan 310. Part of the cooled cold air flows up the first supply duct 151 and part of the cooled cold air flows down the first supply duct 151, thereby being able to flow to an upper portion and a lower portion of the first supply duct 151, respectively.

A plurality of cold air discharge holes 151*a*, 153*a*, and 155*a* may be formed at the supply duct 150.

The first discharge hole 151*a* for discharging cold air to the storing chamber 106 may be formed at the first supply duct 151. The first discharge hole 151*a* may be formed on a front side of the first supply duct 151 and exposed to the storing chamber 106. The cold air discharged from the first discharge hole 151*a* may flow towards the front of the storing chamber 106.

The supply duct 150 includes a second supply duct 153 disposed on the inner case 103 forming the upper wall of the storing chamber 106. The second supply duct 153 may extend forward from the upper portion of the first supply duct 151. The cold air flowing to the upper portion of the first supply duct 151 from the cold air circulation fan 310 may flow forward through the second supply duct 153.

A second discharge hole 153*a* for discharging the cold air in the second supply duct 153 to a front of the storing chamber 106 is formed at a front of the second supply duct 153. For example, the second discharge hole 153*a* may be formed at the front end of the second supply duct 153 and may be positioned adjacent to the door 120. Accordingly, the cold air discharged from the second discharge hole 153*a* may be discharged towards the door 120 and may be supplied to the front of the storing chamber 106 along an inner side of the door 120.

The supply duct 150 includes a third supply duct 155 disposed on the inner case 103 forming the lower wall of the storing chamber 106. The third supply duct 155 may extend forward from the lower portion of the first supply duct 151. The cold air flowing to the lower portion of the first supply duct 151 from the cold air circulation fan 310 may flow forward through the third supply duct 155.

A third discharge hole 155*a* for discharging the cold air in the third supply duct 155 to the front of the storing chamber 106 is formed at a front of the third supply duct 155. For example, the third discharge hole 155*a* may be formed at a front end of the third supply duct 155 and may be positioned adjacent to the door 120. Accordingly, the cold air discharged from the third discharge hole 155*a* may be discharged towards the door 120 and may be supplied to the front of the storing chamber 106 along the inner side of the door 120.

The second discharge hole 153*a* of the second supply duct 153 and the third discharge hole 155*a* of the third supply duct 155 may be formed at a duct cover 157. The duct cover 157, which is a part of the second supply duct 153 and the third supply duct 155, may be disposed to be able to open at the fronts of the second and third ducts 153 and 155.

The refrigerator 10 further includes the cold air accumulation agent 190 disposed in the supply duct 150. The cold air accumulation agent 190 may be configured to have a thin flat plate shape and a predetermined length.

The cold air accumulation agent 190 may be cooled by the cold air flowing through the supply duct 150 and may store the coldness of the cold air. The coldness of the cold air stored in the cold air accumulation agent 190 may cool the storing chamber 106 through conduction or convection. As described above, the cold air accumulation agent 190 may include a phase change material.

The cold air accumulation agent 190 may be disposed in the second supply duct 153 and/or the third supply duct 155. Since the second supply duct 153 and/or the third supply duct 155 is configured to extend forward from the first supply duct 151, the cold air accumulation agent 190 may be easily disposed in the second and third supply duct 153 and 155.

In this embodiment, the cold air accumulation agent 190 includes a first cold air accumulation agent 191 disposed in the second supply duct 153 and a second cold air accumulation agent 195 disposed in the third supply duct 155. The cold air flowing through the second supply duct 153 may cool the first cold air accumulation agent 191 and the cooled first cold air accumulation agent 191 may discharge cold air in a phase change process. In particular, when the cold air circulation fan 310 is not driven, the coldness of the cold air stored in the first cold air accumulation agent 191 may be supplied to the storing chamber 106.

The cold air flowing through the second supply duct 153 may cool the second cold air accumulation agent 195 and the cooled second cold air accumulation agent 195 may discharge cold air in a phase change process. In particular, when the cold air circulation fan 310 is not driven, the coldness of the cold air stored in the second cold air accumulation agent 195 may be supplied to the storing chamber 106.

Referring to FIG. 7, the second cold air accumulation agent 195 and supporting ribs 197*a* and 197*b* that support the second cold air accumulation agent 195 may be included in the third supply duct 155. The second cold air accumulation agent 195 may be disposed at a center portion of the third supply duct 155 and the supporting ribs 197*a* and 197*b* may be disposed over and under the second cold air accumulation agent 195.

In detail, the supporting ribs 197*a* and 197*b* includes a first supporting rib 197*a* supporting a bottom of the second cold air accumulation agent 195 and a second supporting rib 197*b* supporting a top of the second cold air accumulation agent 195. The first and second supporting ribs 197*a* and 197*b* support the bottom and the top of the second cold air accumulation agent 195, thereby being able to prevent the second cold air accumulation agent 195 from being moved by the cold air when the cold air is flowing through the third supply duct 155.

A channel through which the cold air flows is formed in the third supply duct 155. The channel includes a first channel 161 formed under the second cold air accumulation agent 195 and a second channel 163 formed over the second cold air accumulation agent 195. That is, the channel of the third supply duct 155 may be divided into first and second channels 161 and 163 by the second cold air accumulation agent 195. By this structure, the cold air flowing through the third supply duct 155 may uniformly cool the second cold air accumulation agent 195.

A first height H1 in the up-down direction of the first channel 161 may be larger than a second height H2 in the up-down direction of the second channel 163. The cold air flowing through the third supply duct 155 makes for a relatively low temperature, so the cold air may have a tendency of being biased to flow in the first channel 161 of the channel of the third supply duct 155. Accordingly, it is possible to guide the flow of cold air more smoothly by making the first channel 161 relative large in comparison to the second channel 163.

The duct cover 157 may be provided to open at the front of the third supply duct 155. When the duct cover 157 is opened, the second cold air accumulation agent 195 may be separated from the the third supply duct 155 through the open front of the third supply duct 155.

Although the internal structure of the third supply duct 155 was exemplified with reference to FIG. 7, this description may be equally applied to the internal structure of the second supply duct 153 and the first cold air accumulation agent 191.

Figure 10:
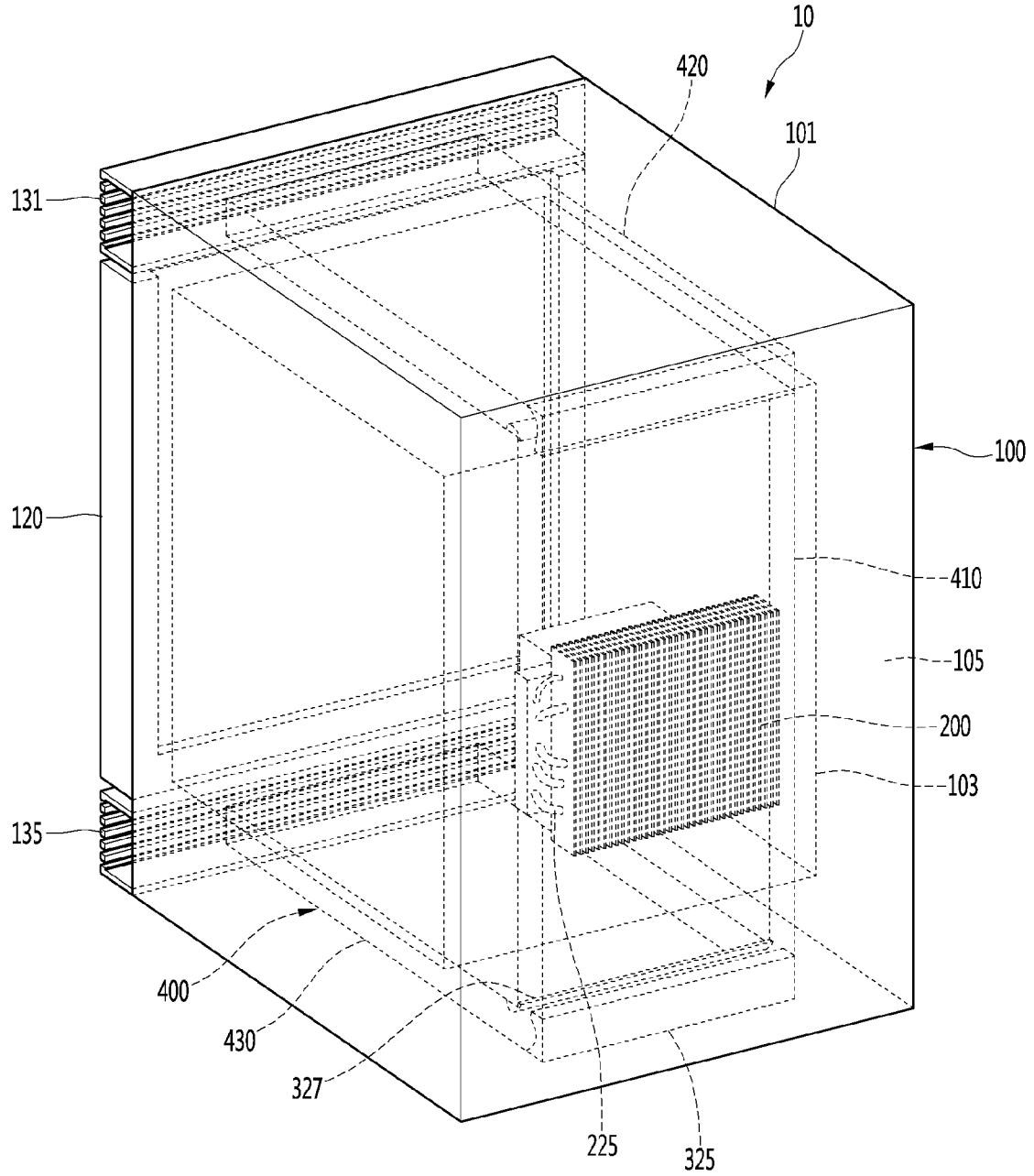
FIG. 10 is a view showing a state in which a heat dissipation duct according to the first embodiment of the present invention has been disposed in the cabinet.
Figure 11:
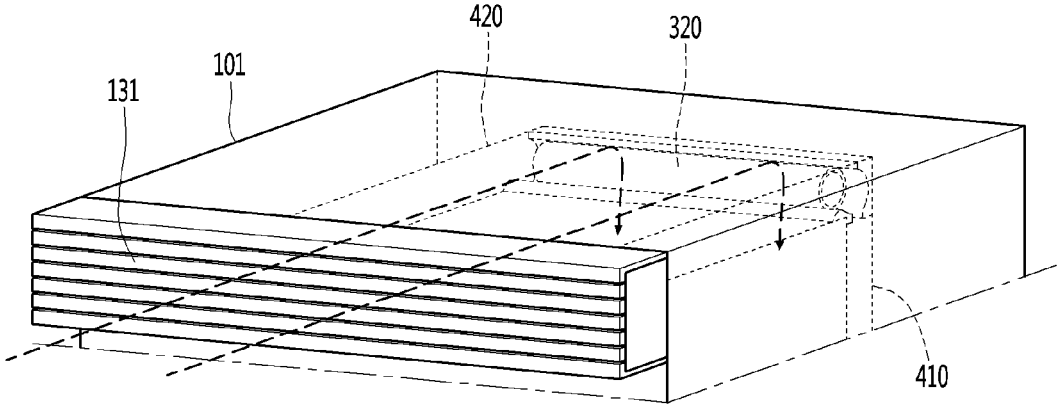
FIG. 11 is a view showing an arrangement of the heat dissipation duct and a heat dissipation fan according to the first embodiment of the present invention.
Figure 12:
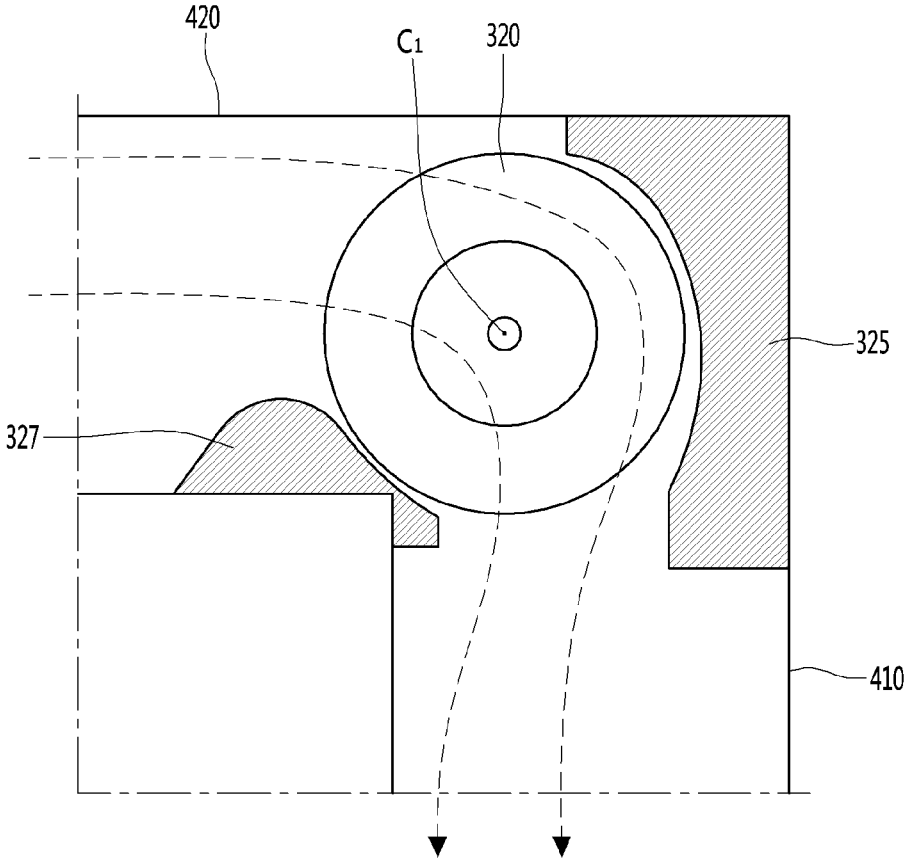
FIG. 12 is a view showing a flow of external air through the heat dissipation fan according to the first embodiment of the present invention.

FIG. 10 is a view showing a state in which a heat dissipation duct according to the first embodiment of the present invention has been disposed in the cabinet, FIG. 11 is a view showing an arrangement of the heat dissipation duct and a heat dissipation fan according to the first embodiment of the present invention, and FIG. 12 is a view showing a flow of external air through the heat dissipation fan according to the first embodiment of the present invention.

Referring to FIGS. 10 to 12, the refrigerator 10 according to the first embodiment of the present invention further includes the heat dissipation duct 400 embedded in the cabinet insulator 105. The heat dissipation duct 400 may be understood as a duct connected to external air outside the refrigerator 10.

The heat dissipation duct 400 includes a first heat dissipation duct 410 disposed in the cabinet insulator 105 disposed at the rear portion of the cabinet 100, a second heat dissipation duct 420 extending forward from an upper portion of the first heat dissipation duct 410 and communicating with the first inlet-output grill 131, and a third heat dissipation duct 430 extending forward from a lower portion of the first heat dissipation duct 410 and communicating with the second inlet-output grill 135.

The heat-dissipating sink 220 of the thermoelectric element module 200 may be positioned in the first heat dissipation duct 410. Accordingly, the external air flowing through the first heat dissipation duct 410 may exchange heat with the heat-dissipating sink 220.

The first inlet-output portion 441 (see FIG. 3) is disposed adjacent to the first inlet-outlet grill 131 and introduces external air flowing inside the refrigerator 10 through the first inlet-output grill 131 or guides external air in the second heat dissipation duct 420 to the first inlet-output grill 131.

The second inlet-output portion 445 is disposed adjacent to the second inlet-outlet grill 135 and introduces external air flowing inside the refrigerator 10 through the second inlet-output grill 135 or guides external air in the third heat dissipation duct 420 to the second inlet-output grill 135.

First and second heat dissipation fans 320 and 330 (see FIG. 13) that forcibly circulate external air may be disposed in the heat dissipation duct 400. The first heat dissipation fan 320 may be disposed over the first heat dissipation duct 410, that is, at a joint of the first heat dissipation duct 410 and the second heat dissipation duct 420. The second heat dissipation fan 330 may be disposed under the first heat dissipation duct 410, that is, at a joint of the first heat dissipation duct 410 and the third heat dissipation duct 430.

A transverse fan may be used for the first and second heat dissipation fans 320 and 330. The transverse fan, which is a fan circumferentially suctioning and circumferentially discharging air, may guide external air from the first heat dissipation duct 410 to the second heat dissipation duct 420 or the third heat dissipation duct 430.

Flow guides 325 and 327 that guide for stable flow of air may be disposed around the first and second heat dissipation fans 320 and 330, respectively. The flow guides 325 and 327 include a rear guide 325 disposed at a side of the heat dissipation fans 320 and 330 and a stabilizer 327 disposed at the other side of the heat dissipation fans 320 and 330.

The rear guide 325 is disposed adjacent to an outer side of the heat dissipation fans 320 and 330, thereby being able to guide the air sucked into the heat dissipation fans 320 and 330 to be circumferentially discharged. The stabilizer 327 may perform a function of preventing the air discharged from the heat dissipation fans 320 and 330 from being sucked back into the heat dissipation fans 320 and 330.

The rear guide 325 and the stabilizer 327 may be positioned at opposite sides with the center C1 of the heat dissipation fans 320 and 330 therebetween. The stabilizer 327 may be positioned closer to the storing chamber 106 in comparison to the rear guide 325.

Figure 13:
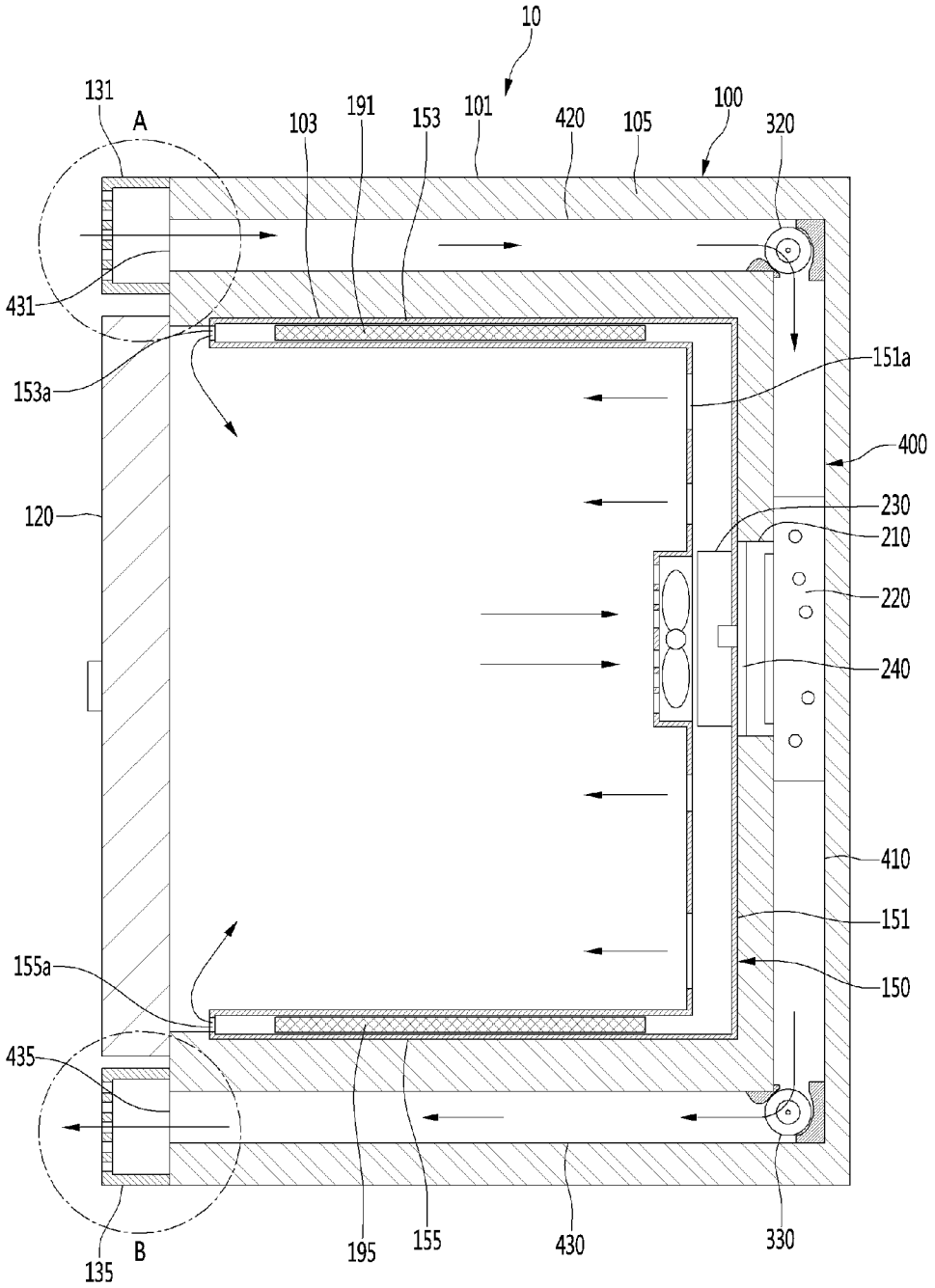
FIG. 13 is a view showing an example of a flow of cold air and external air in the structure of the refrigerator according to the first embodiment of the present invention.
Figure 14:
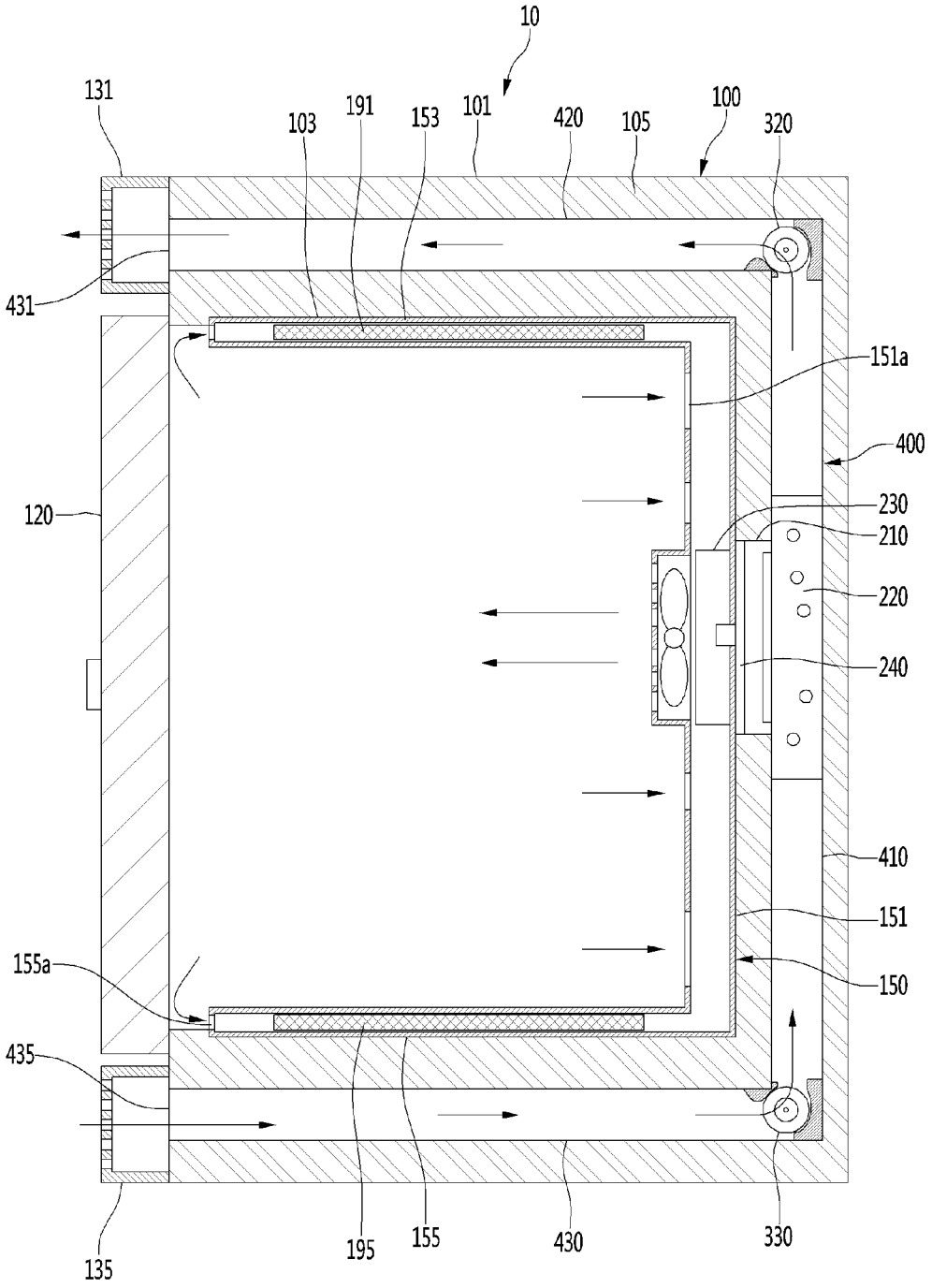
FIG. 14 is a view showing another example of a flow of cold air and external air in the structure of the refrigerator according to the first embodiment of the present invention.

FIG. 13 is a view showing an example of flow of cold air and external air in a structure of the refrigerator according to the first embodiment of the present invention and FIG. 14 is a view showing another example of flow of cold air and external air in the structure of the refrigerator according to the first embodiment of the present invention.

The inflow and discharge directions of external air may depend on the rotational direction of the first heat dissipation fan 320 and the second heat dissipation fan 330.

For example, referring to FIG. 13, when the first and second heat dissipation fans 320 and 330 are rotated clockwise, external air flows into the second heat dissipation duct 420 through the first inlet-output grill 131. The external air may absorb heat by exchanging heat with the heat-dissipating sink 220 disposed in the first heat dissipation duct 410 and then may be discharged from the third heat dissipation duct 430 through the second inlet-output grill 135.

As another example, referring to FIG. 14, when the first and second heat dissipation fans 320 and 330 are rotated counterclockwise, external air flows into the third heat dissipation duct 430 through the second inlet-output grill 135. The external air may absorb heat by exchanging heat with the heat-dissipating sink 220 disposed in the first heat dissipation duct 410 and then may be discharged from the second heat dissipation duct 420 through the first inlet-output grill 131.

Figure 15:
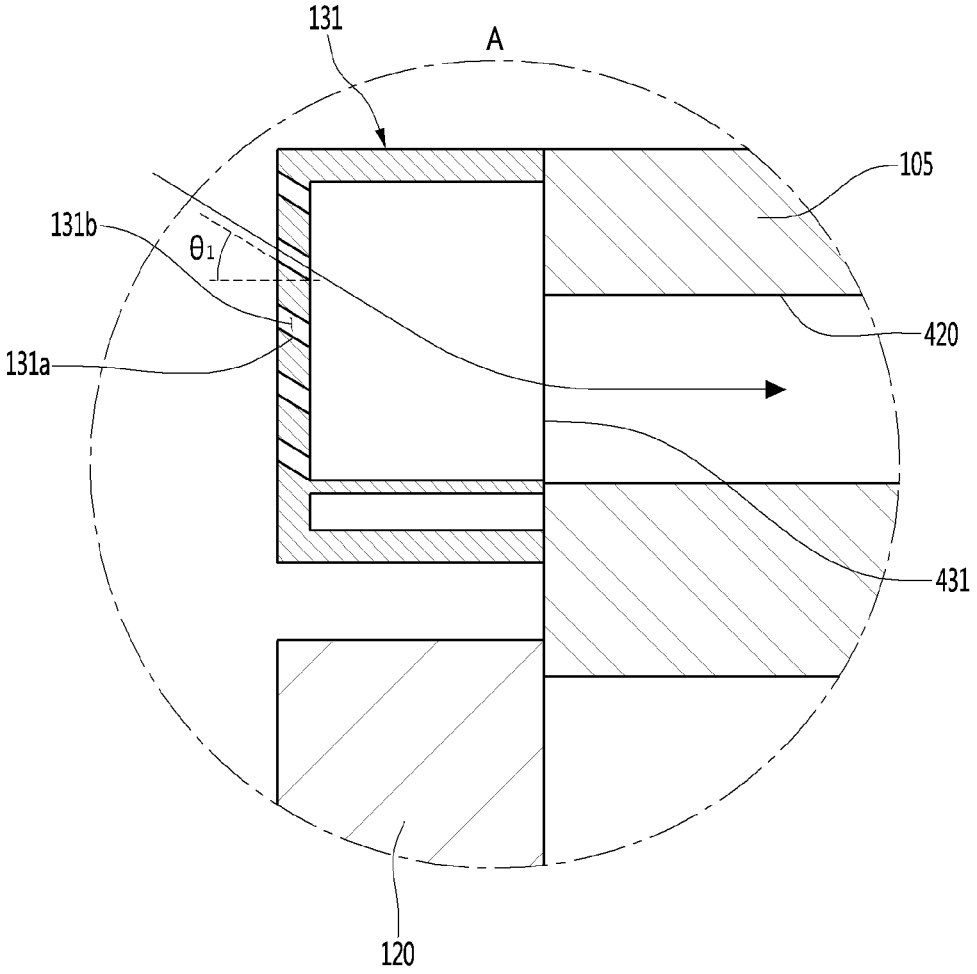
FIG. 15 is an enlarged view of a portion "A" of FIG. 13.
Figure 16:
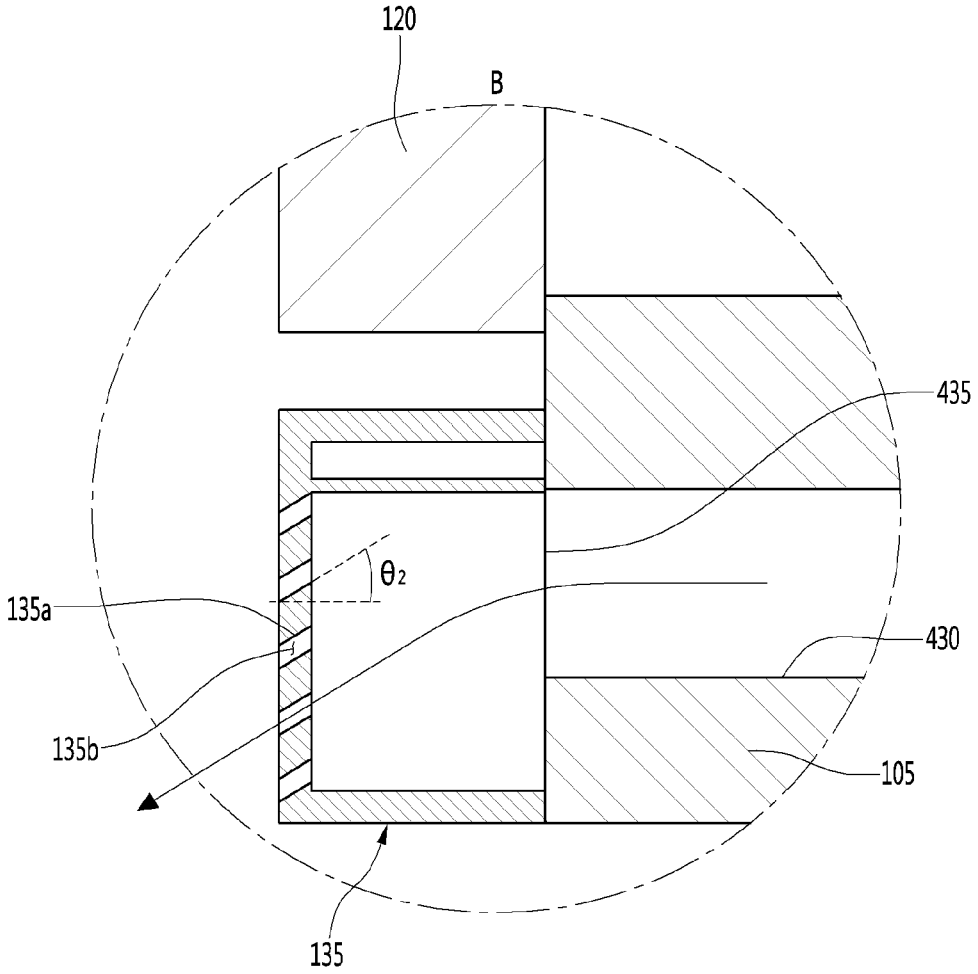
FIG. 16 is an enlarged view of a portion "B" of FIG. 13.

FIG. 15 is an enlarged view of a portion "A" of FIG. 13 and FIG. 16 is an enlarged view of a portion "B" of FIG. 13.

Referring to FIGS. 15 and 16, the inlet-output grills 131 and 135 may have guide ribs extending at an angle with respect to a horizontal axis for inflow and discharge of external air.

In detail, the first inlet-output grill 131 has a plurality of first guide ribs 131*a* extending downward at a first set angle 01 with respect to the horizontal axis in a direction facing the inside from the outside of the refrigerator. A plurality of first inlet-output holes 131*b* through which external air may be sucked in and discharged may be formed between the first guide ribs 131*a*.

By this configuration, the external air outside the refrigerator 10 may flow into the first inlet-output grill 131 and into the second heat dissipation duct 420 while flowing diagonally downward ahead of the first inlet-output grill 131. Accordingly, it may be possible to prevent the external air from flowing into the storing chamber 106 through the door 120 when the external air passes the first inlet-output grill 131.

Although FIG. 15 shows the flow of external air into the first inlet-output grill 131 when the external air flow is generated as in FIG. 13, when the flow of external air is generated as in FIG. 14, the external air may be discharged out of the refrigerator 10 from the first inlet-output grill 131.

Referring to FIG. 16, the second inlet-output grill 135 has a plurality of second guide ribs 135*a* extending upward at a second set angle θ2 with respect to the horizontal axis in a direction facing the inside from the outside of the refrigerator. A plurality of second inlet-output holes 135*b* through which external air may be sucked in and discharged may be formed between the second guide ribs 135*a*.

By this configuration, the external air inside the refrigerator 10 may be discharged out of the refrigerator while diagonally flowing downward toward a front lower portion of the second inlet-output grill 135 from the third heat dissipation duct 430. Accordingly, it may be possible to prevent the external air from flowing into the storing chamber 106 through the door 120 when the external air passes the second inlet-output grill 135.

Although FIG. 16 shows the flow of external air discharged out of the second inlet-output grill 135 when the external air flow is generated as in FIG. 13, when the flow of external air is generated as in FIG. 14, the external air may flow into the refrigerator 10 through the second inlet-output grill 135.

Figure 17:
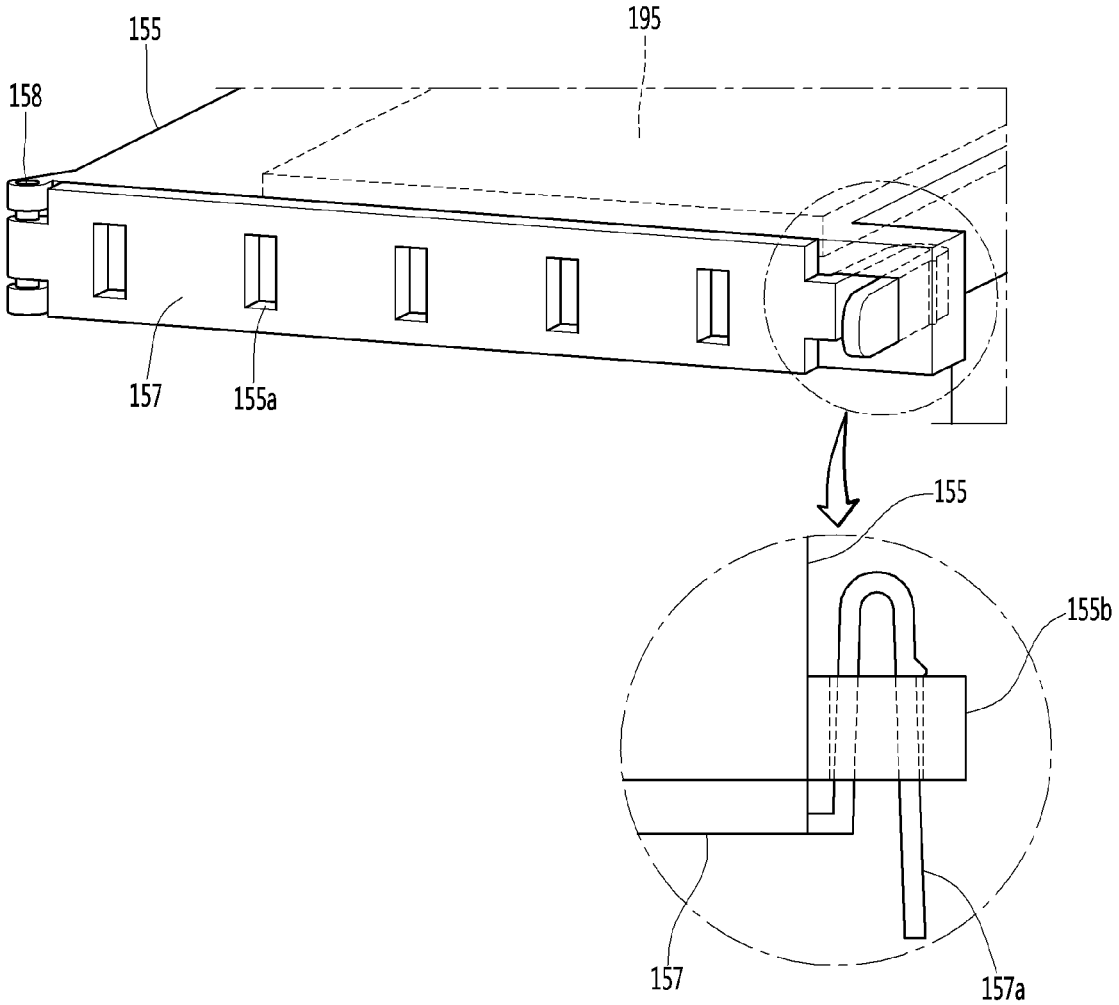
FIG. 17 is a view showing a state in which a duct cover has been coupled to a front of the supply duct according to the first embodiment of the present invention.
Figure 18:
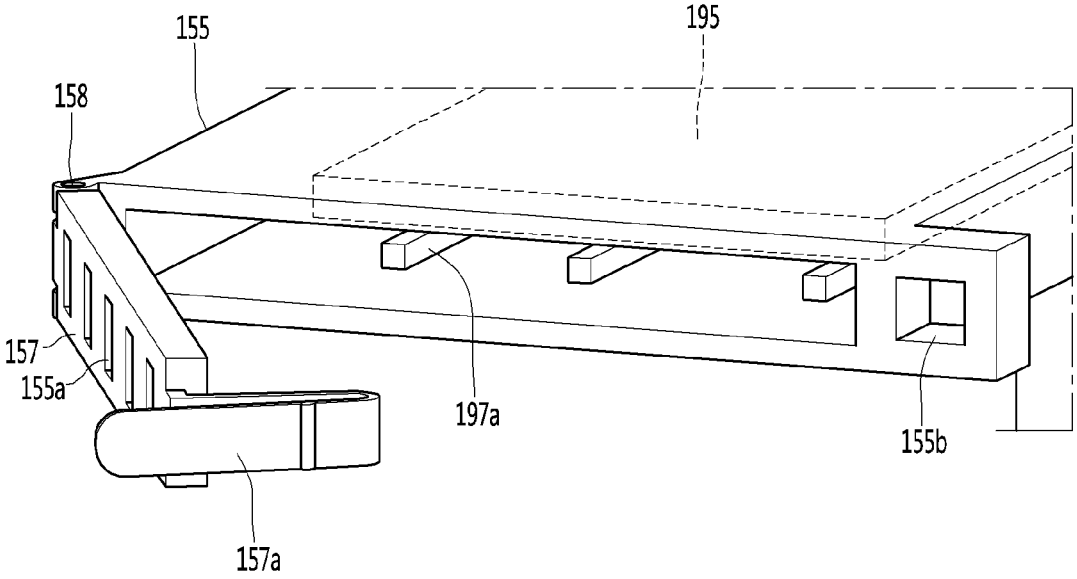
FIG. 18 is a view showing a state in which the duct cover according to first embodiment of the present invention is open.

FIG. 17 is a view showing a state in which the duct cover 157 has been coupled to the front of the supply duct according to the first embodiment of the present invention and FIG. 18 is a view showing a state in which the duct cover according to first embodiment of the present invention is open.

Referring to FIGS. 17 and 18, the duct cover 157 may be disposed at the front of the second supply duct 153 or the third supply duct 155. FIG. 17 shows the duct cover 157 disposed at the third supply duct 155 and the description about the duct cover 157 may be equally applied to the duct cover 157 disposed at the second supply duct 153.

The duct cover 157 may be hinged to the open front of the third supply duct 155. To this end, a hinge shaft 158 is disposed on the third supply duct 155, and a side of the duct cover 157 is coupled to the hinge shaft 158 and the other side of the duct cover 157 may be rotated about the hinge shaft 158.

A third discharge hole 155*a* may be formed at the duct cover 157. A plurality of third discharge holes 155*a* are formed and may be laterally arranged.

A hook 157*a* is disposed at the other side of the duct cover 157 and may be coupled to a hook groove 155*b* of the third supply duct 155. When the hook 157*a* is separated from the hook groove 155*b* and the duct cover 157 is rotated forward, the inside of the third supply duct 155 may be accessed. For example, the second cold air accumulation agent 195 may be taken out through the front of the third supply duct 155.

A second embodiment of the present invention is described hereafter. This embodiment is different in the configuration of the supply duct for cold air, as compared with the first embodiment, so this difference is mainly described and the same components as those of the first embodiment are given the same reference numeral and description as in the first embodiment.

Figure 19:
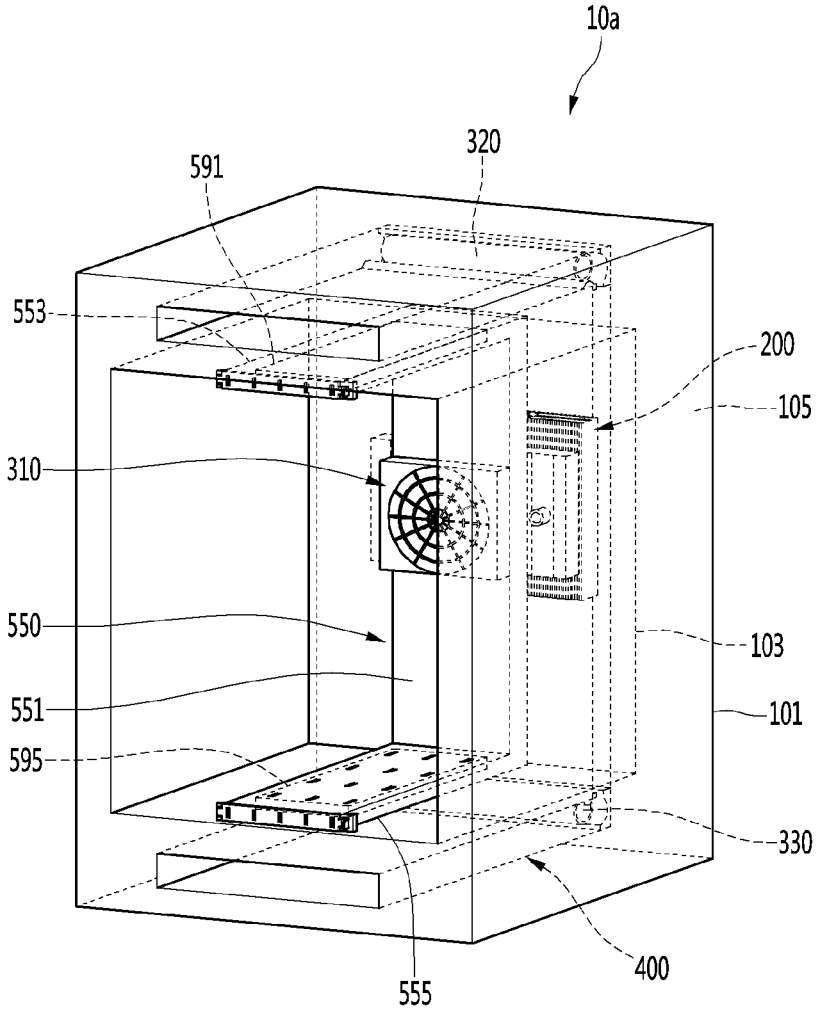
FIG. 19 is a view showing an internal configuration of a cabinet according to a second embodiment of the present invention.
Figure 20:
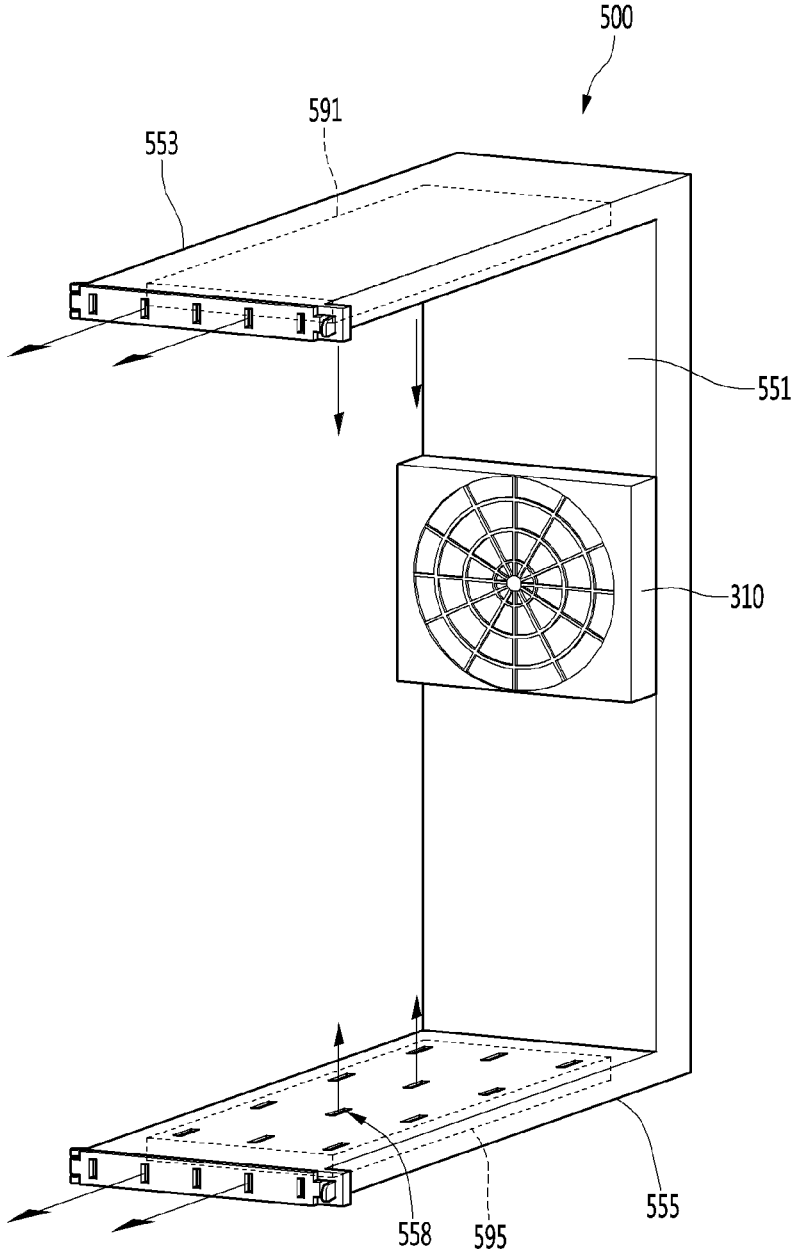
FIG. 20 is a perspective view showing a configuration of a supply duct according to the second embodiment of the present invention.
Figure 21:
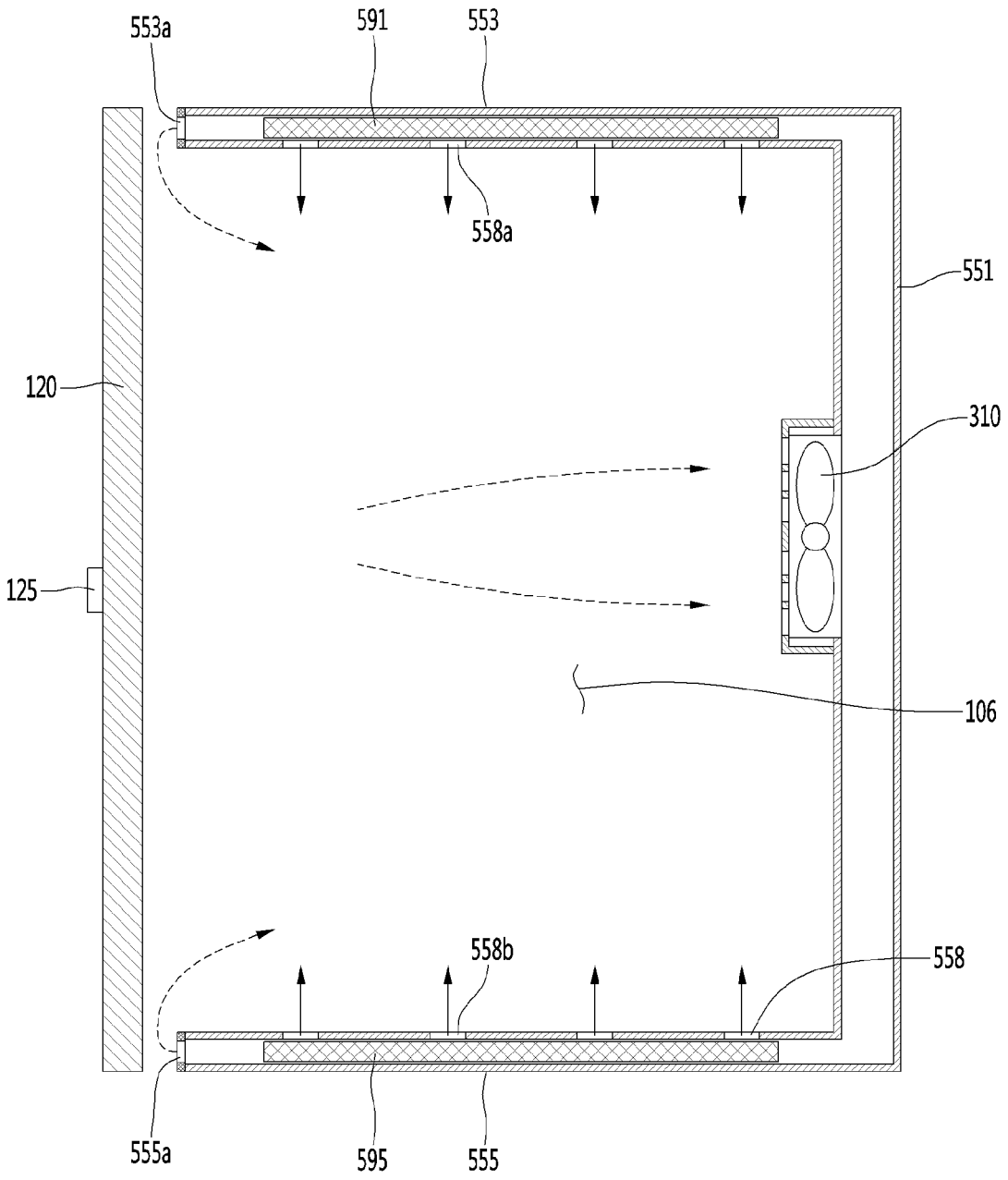
FIG. 21 is a view showing a state in which air is supplied from the supply duct to a storing chamber according to the second embodiment of the present invention.
Figure 22:
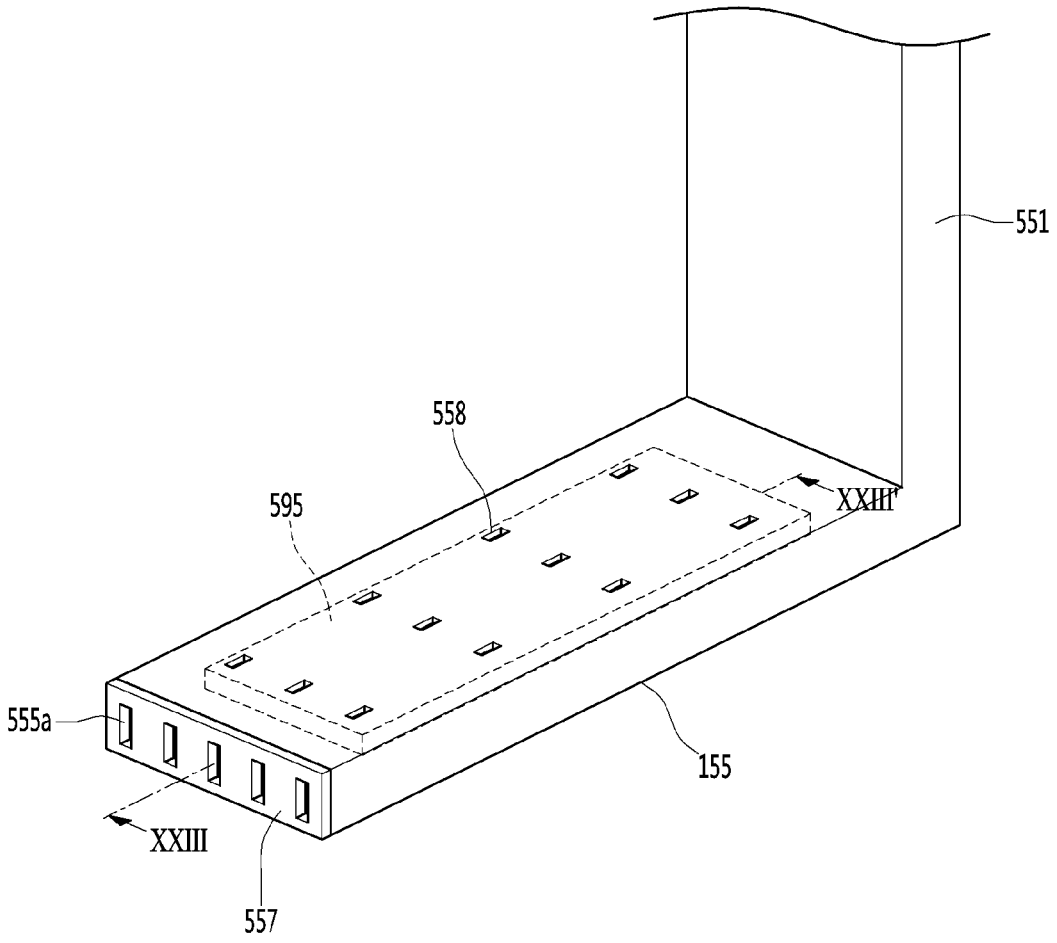
FIG. 22 is a view showing a state in which a cold air accumulation agent according to the second embodiment of the present invention has been disposed in the supply duct.
Figure 23:
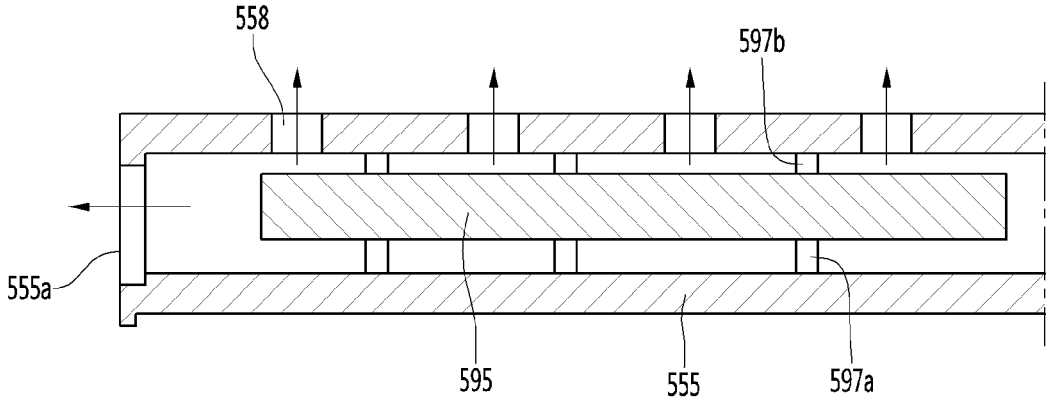
FIG. 23 is a cross-sectional view taken along line XXIII-XXIII' of FIG. 22.

FIG. 19 is a view showing an internal configuration of a cabinet according to the second embodiment of the present invention, FIG. 20 is a perspective view showing a configuration of the supply duct according to the second embodiment of the present invention, FIG. 21 is a view showing a state in which air is supplied from the supply duct to the storing chamber according to the second embodiment of the present invention, FIG. 22 is a view showing a state in which a cold air accumulation agent according to the second embodiment of the present invention has been disposed in the supply duct, and FIG. 23 is a cross-sectional view taken along line XXIII-XXIII' of FIG. 22.

Referring to FIGS. 19 to 23, a refrigerator 10*a* according to the second embodiment of the present invention includes a supply duct 550 having a U-shaped bent shape.

In detail, the supply duct 550 includes a first supply duct 551 disposed on the rear wall of the storing chamber 106, a second supply duct 553 extending forward from an upper portion of the first supply duct 551, and a third supply duct 555 extending forward from a lower portion of the first supply duct 510.

A first cold air accumulation agent 591 may be disposed in the second supply duct 553 and a second cold air accumulation agent 595 may be disposed in the third supply duct 555. The first and second cold air accumulation agents 591 and 595 may be stably supported by supporting ribs 597*a* and 597*b* disposed in the second and third supply ducts 553 and 555. The bottom of the first and second cold air accumulation agents 591 and 595 may be supported by the first supporting rib 597*a* and the top of the first and second cold air accumulation agents 591 and 595 may be supported by the second supporting rib 597*b*.

Further, the description in the first embodiment is equally applicable for the first and second cold air accumulation agents 591 and 595 and the installation structure.

Duct discharge holes 558 for discharging the cold air flowing in the ducts upward or downward toward the storing chamber 106 are formed at the second supply duct 553 and the third supply duct 555.

In detail, the duct discharge holes 558 may include a first duct discharge hole 558*a* formed at a bottom surface of the second supply duct 553 to discharge cold air downward toward the storing chamber 106. A plurality of first duct discharge holes 558*a* may be formed and spaced apart from each other in a front-rear direction to correspond to the extension direction of the second supply duct 553.

In detail, the duct discharge holes 558 may include a second duct discharge hole 558*b* formed at a top surface of the third supply duct 555 to discharge cold air upward toward the storing chamber 106. A plurality of second duct discharge holes 558*b* may be formed and spaced apart from each other in the front-rear direction to correspond to the extension direction of the third supply duct 555.

By this configuration, the cold air in the second supply duct 553 may be discharged to the storing chamber 106 through second discharge holes 553*a* and the first duct discharge holes 558*a*, so the storing chamber 106 may be easily cooled. Further, the cold air in the third supply duct 555 may be discharged to the storing chamber 106 through third discharge holes 555*a* and the second duct discharge holes 558*b*, so the storing chamber 106 may be easily cooled.

A third embodiment of the present invention is described hereafter. This embodiment is different in that a drawer is provided in the cabinet, as compared with the first embodiment, so this difference is mainly described and the same components as those of the first embodiment are given the same reference numeral and description as in the first embodiment.

Figure 24:
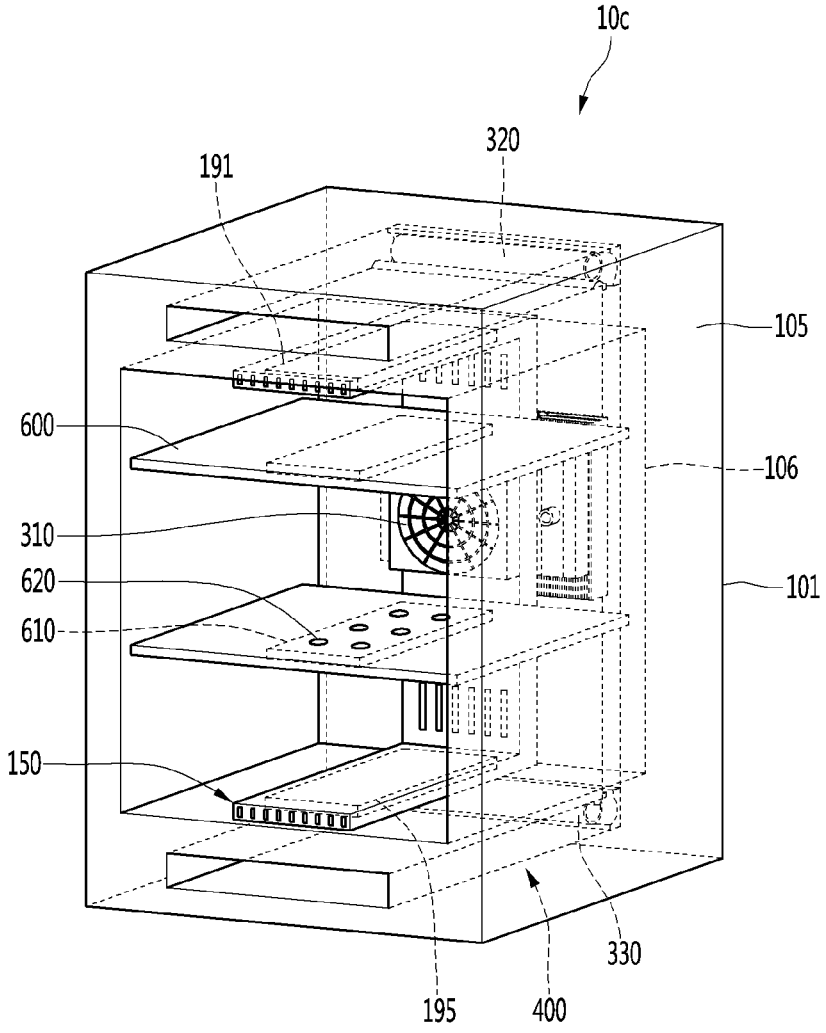
FIG. 24 is a view showing an internal configuration of a cabinet according to a third embodiment of the present invention.

FIG. 24 is a view showing an internal configuration of a cabinet according to the third embodiment of the present invention.

Referring to FIG. 24, a refrigerator 10c according to the third embodiment of the present invention includes a shelf 600 in the storing chamber 106. The shelf 600 may have a flat plate shape and both sides of the shelf 600 may be separably coupled to the inner case 103. A plurality of shelves 600 may be provided and they may be spaced apart from each another in the up-down direction. Objects to be stored may be received on the shelf 600.

A shelf cold air accumulation member 610 may be disposed in the shelf 600. The description about the cold air accumulation agent 190 described in the first embodiment is applicable for the shelf cold air accumulation agent 610.

A shelf cold air accumulation agent hole 620 may be formed at the shelf 600. A plurality of shelf cold air accumulation agent holes 620 may be formed at the top and/or the bottom of the shelf 600. The cold air in the storing chamber 106 may cool the shelf cold air accumulation agent 610 by flowing into the shelf 600 through the shelf cold air accumulation agent holes 620.

The coldness of the cold air stored in the shelf cold air accumulation agent 610 may cool the storing chamber 106 through conduction or convection. As described above, the shelf cold air accumulation agent 610 is disposed in the shelf receiving object to be stored, and the storing chamber 106 may be easily cooled.

Figure 25:
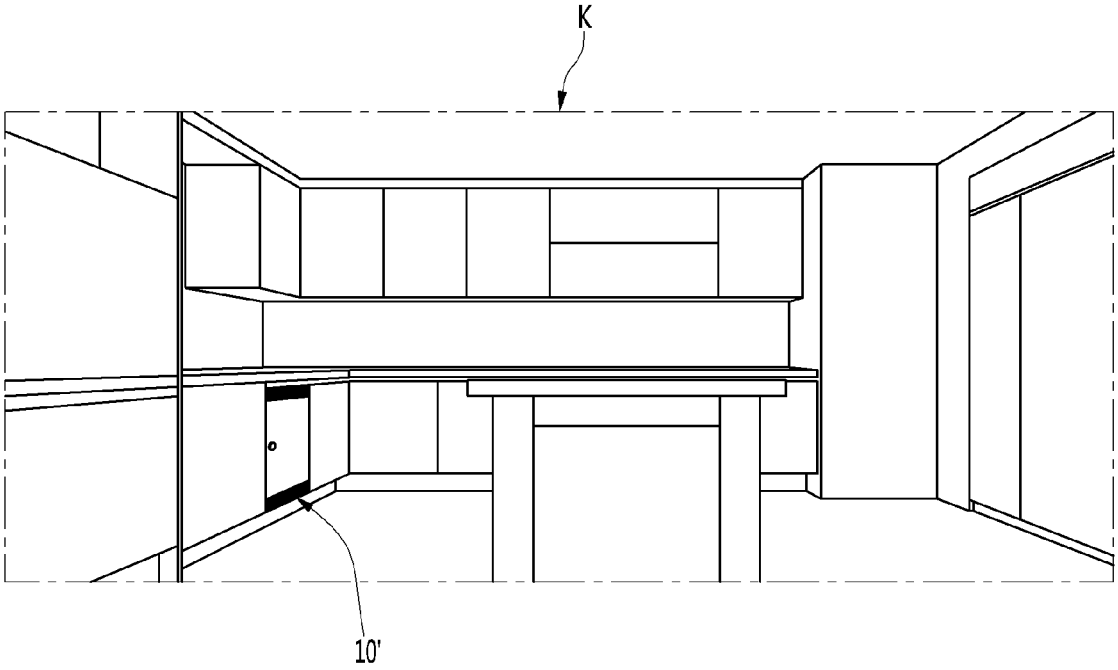
FIG. 25 is a view showing a state when a refrigerator according to an embodiment of the present invention has been installed at a place in a house.

FIG. 25 is a view showing a state when a refrigerator according to an embodiment of the present invention has been installed at a place in a house.

As described above, the refrigerator 10' may be built in a piece of furniture to fit the structure of the furniture and may be used as a portable refrigerator by being separable from the furniture.

Referring to FIG. 25, the refrigerator 10' having the same structure as the refrigerators described in the previous embodiments has been installed in a kitchen K. For example, the refrigerator 10' may be installed at a predetermined receiving space provided at the sink in the kitchen, so it is possible to wash vegetables and fruits at the sink and then directly keep them in the refrigerator 10'.

Further, since cooking devices that are usually installed at the sink and the refrigerator 10' is positioned close by, it is possible to use sauces for cooking at the cooking devices and then simply keep them in the refrigerator 10'.

What is claimed is:

1. A refrigerator comprising:

a cabinet including an inner case forming a storing chamber, an outer case surrounding the inner case and a cabinet insulator disposed between the inner case and the outer case;

a door provided at the cabinet, the door to open the storing chamber;

a thermoelectric element module provided at a wall of the storing chamber and including a heat-absorbing sink and a heat-dissipating sink;

a supply duct provided at the inner case, the supply duct to discharge cold air heat- exchanged in the heat-absorbing sink to the storing chamber;

a cold air circulation fan provided at a side of the heat-absorbing sink, the cold air circulation fan to blow the cold air in the storing chamber towards the heat-absorbing sink;

a phase change material provided in the supply duct, the phase change material to be cooled by the cold air flowing through the supply duct;

a heat dissipation duct provided at the cabinet insulator, the heat dissipation duct to discharge the air heat-exchanged in the heat-dissipating sink to an outside of the refrigerator; and a heat dissipation fan provided in the heat dissipation duct, the heat dissipation fan to force external air to flow in the heat dissipation duct, wherein the cabinet includes a top wall, a bottom wall and a rear wall, wherein the heat dissipation fan includes a first heat dissipation fan disposed at a first joint of the top wall and the rear wall and a second heat dissipation fan disposed at a second joint of the bottom wall and the rear wall, and wherein the cold air circulation fan is located on a center portion of a rear wall of the storing chamber.

2. The refrigerator of claim 1, wherein the supply duct includes:

a first supply duct disposed on the rear wall of the storing chamber and having a first discharge hole for discharging the cold air to the storing chamber;

a second supply duct extending forward from an upper portion of the first supply duct and having the phase change material therein; and a second discharge hole formed at a front of the second supply duct to discharge the cold air towards the door.

3. The refrigerator of claim 1, wherein the supply duct includes:

a first supply duct disposed on the rear wall of the storing chamber and having a first discharge hole for discharging the cold air to the storing chamber;

an additional supply duct extending forward from a lower portion of the first supply duct and having the phase change material therein; and an additional discharge hole formed at a front of the additional supply duct to discharge the cold air towards the door.

4. The refrigerator of claim 1, wherein the supply duct includes:

a first supply duct disposed on a rear wall of the storing chamber and having a first discharge hole;

a second supply duct disposed on an upper wall of the storing chamber and having a second discharge hole; and a third supply duct disposed on a lower wall of the storing chamber and having a third discharge hole.

5. The refrigerator of claim 4, wherein the phase change material is disposed in at least one of the second supply duct and the third supply duct.

6. The refrigerator of claim 1, wherein the supply duct includes first and second channels in which the cold air flows and divided by the phase change material.

7. The refrigerator of claim 6, wherein the supply duct includes a supporting rib that supports a top or a bottom of the phase change material, wherein the first channel defines a lower channel under the phase change material, and the second channel defines an upper channel over the phase change material.

8. The refrigerator of claim 6, wherein a first height of the first channel is higher than a second height of the second channel.

9. The refrigerator of claim 4, wherein a duct discharge hole for discharging the cold air to the storing chamber is formed at a bottom surface of the second supply duct or a top surface of the third supply duct.

10. The refrigerator of claim 1, wherein the heat dissipation duct is disposed to surround the supply duct.

11. The refrigerator of claim 1, wherein the heat dissipation duct includes:

a first heat dissipation duct disposed at a rear portion of the cabinet insulator and having the heat-dissipating sink therein;

a second heat dissipation duct extending forward from a upper portion of the first heat dissipation duct and having a first inlet for introducing or discharging the external air; and a third heat dissipation duct extending forward from a lower portion of the first heat dissipation duct and having a second inlet for introducing or discharging the external air.

12. The refrigerator of claim 11, comprising:

a first inlet grill disposed over the door and communicating with the first inlet of the second heat dissipation duct; and a second inlet grill disposed under the door and communicating with the second inlet of the third heat dissipation duct.

13. The refrigerator of claim 12, further comprising:

a plurality of guide ribs disposed at the first inlet grill or the second inlet grill and extending at an angle upward or downward with respect to a horizontal axis; and an inlet hole disposed between the plurality of guide ribs.

14. The refrigerator of claim 4, wherein the cold air circulation fan includes a centrifugal fan disposed at a center portion of the first supply duct.

15. The refrigerator of claim 11, wherein the first heat dissipation fan is disposed at a joint of the first heat dissipation duct and the second heat dissipation duct; and the second heat dissipation fan is disposed at a joint of the first heat dissipation duct and the third heat dissipation duct.

16. The refrigerator of claim 15, wherein the first heat dissipation fan or the second heat dissipation fan includes a cross-flow fan.

17. The refrigerator of claim 1, comprising a duct cover rotatably coupled to the supply duct to open an internal channel of the supply duct.

18. The refrigerator of claim 1, further comprising:

a shelf disposed in the storing chamber; and a shelf cold air accumulation agent disposed in the shelf.

19. A refrigerator comprising:

a cabinet including an inner case forming a storing chamber, an outer case surrounding the inner case and a cabinet insulator disposed between the inner case and the outer case;

a door provided at the cabinet, the door to open the storing chamber;

a thermoelectric element module provided at a wall of the storing chamber and including a heat-absorbing sink and a heat-dissipating sink;

a supply duct provided at the inner case, the supply duct to discharge cold air heat-exchanged in the heat-absorbing sink to the storing chamber;

a cold air circulation fan provided at a side of the heat-absorbing sink, the cold air circulation fan to blow the cold air in the storing chamber towards the heat-absorbing sink; and a cold air accumulation agent provided in the supply duct, the cold air accumulation agent to be cooled by the cold air flowing through the supply duct, wherein the supply duct includes:

a first supply duct disposed on a rear wall of the storing chamber and having a first discharge hole for discharging the cold air to the storing chamber;

a second supply duct extending forward from an upper portion or a lower portion of the first supply duct and having the phase change material therein; and a second discharge hole formed at a front of the second supply duct to discharge the cold air towards the door.

20. A refrigerator comprising:

a cabinet including an inner case forming a storing chamber, an outer case surrounding the inner case and a cabinet insulator disposed between the inner case and the outer case;

a door provided at the cabinet, the door to open the storing chamber;

a thermoelectric element module provided at a wall of the storing chamber and including a heat-absorbing sink and a heat-dissipating sink;

a supply duct provided at the inner case, the supply duct to discharge cold air heat-exchanged in the heat-absorbing sink to the storing chamber;

a cold air circulation fan provided at a side of the heat-absorbing sink, the cold air circulation fan to blow the cold air in the storing chamber towards the heat-absorbing sink; and a cold air accumulation agent provided in the supply duct, the cold air accumulation agent to be cooled by the cold air flowing through the supply duct, wherein the supply duct includes:

a first supply duct disposed on a rear wall of the storing chamber and having a first discharge hole;

a second supply duct disposed on an upper wall of the storing chamber and having a second discharge hole; and a third supply duct disposed on a lower wall of the storing chamber and having a third discharge hole.

* * * * *